US007230535B2

(12) United States Patent
Jackson, III et al.

(10) Patent No.: US 7,230,535 B2
(45) Date of Patent: Jun. 12, 2007

(54) METHOD AND APPARATUS FOR MONITORING BREEDING BEHAVIOR

(76) Inventors: William R. Jackson, III, 7112 Washington, Kansas City, MO (US) 64118; James Timothy Jackson, 16002 County Rd. 311, Savannah, MO (US) 64485

( * ) Notice: Subject to any disclaimer, the term of this patent is extended or adjusted under 35 U.S.C. 154(b) by 390 days.

(21) Appl. No.: 10/881,460

(22) Filed: Jun. 30, 2004

(65) Prior Publication Data

US 2005/0012623 A1 Jan. 20, 2005

Related U.S. Application Data

(60) Provisional application No. 60/488,582, filed on Jul. 17, 2003.

(51) Int. Cl.
*G08B 13/14* (2006.01)

(52) U.S. Cl. ..... 340/572.1; 340/572.3; 340/523.1; 340/539.1; 340/10.41; 119/174; 119/823; 119/859

(58) Field of Classification Search ..... 340/572.1, 340/572.3, 523.1, 539.1, 10.41; 119/174, 119/859, 823
See application file for complete search history.

(56) References Cited

U.S. PATENT DOCUMENTS 3,844,273 A 10/1974 Polson
4,224,949 A 9/1980 Scott et al.
4,247,758 A * 1/1981 Rodrian ..... 377/6
4,411,274 A 10/1983 Wright
4,455,610 A 6/1984 Rodrian
4,696,258 A 9/1987 Magrath et al.
4,784,155 A 11/1988 Mills
4,846,106 A 7/1989 Leonard
4,895,165 A * 1/1990 Blair ..... 600/551
5,542,431 A 8/1996 Starzl et al.
5,881,673 A 3/1999 Beach et al.

(Continued)

FOREIGN PATENT DOCUMENTS

GB 20/76259 10/1981
JP 07039268 2/1995
WO WO 95/32616 12/1995

(Continued)

OTHER PUBLICATIONS

IMV International Corporation, (visited Dec. 15, 2003) <http://www.imvusa.com/Show%20Heat/Showheatintro.htm>.

(Continued)

*Primary Examiner*—Tai T. Nguyen
(74) *Attorney, Agent, or Firm*—Shook, Hardy & Bacon, L.L.P.

(57) ABSTRACT

Apparatus and method for detecting when an animal is in heat is provided. The apparatus includes a logic controller, a power source, a clock, an actuator, and a presentation interface such as an array of LEDs (Light-Emitting Diodes) that records breeding behavior in animals and presents corresponding data in a manner that can readily be observed from a distance. The method includes, according to some embodiments, receiving a first stimulus, validating that the first stimulus was received incident to a first mating-behavior event, receiving a second stimulus incident to a second mating-behavior event; and storing the occurrence of the first stimulus along with a time indicator for future retrieval and display on a presentation interface, wherein the presentation interface includes an LED array.

25 Claims, 46 Drawing Sheets

U.S. PATENT DOCUMENTS

| | | | | |
|---|---|---|---|---|
| 5,958,704 | A | 9/1999 | Starzl et al. | |
| 6,236,318 | B1 * | 5/2001 | Yang et al. | 340/573.3 |
| 6,467,430 | B1 * | 10/2002 | Stampe | 119/174 |

FOREIGN PATENT DOCUMENTS

| | | |
|---|---|---|
| WO | WO 00/36907 | 6/2000 |
| WO | WO 00/60979 | 10/2000 |

OTHER PUBLICATIONS

Jim Reed and Linda Reed, "Great Plains Livestock Technologies", (visited Feb. 11, 2003) <http://greatplainslivestock.tripod.com/products.html>.

H.C. Wagner and M. Thibier, 14th International Congress on Animal Reproduction, Abstracts, vol. 2, Stockholm, Jul. 2-6, 2000, p. 76-77, (2 pages).

"MountCount Operating Instructions," DDX, Inc. Detection & Diagnostics Technologies Article (8 pages) (No Date).

Boyd, Louis J., Hindsight and Foresight, A1 1992, Proceedings of the 14th Technical Conference on Artificial Insemination & Reproduction, pp. 6-11.

Ann Huffine, et al., "Artificial Insemniation Handbook," National Association of Animal Breeders, 1998, (32 pages).

* cited by examiner

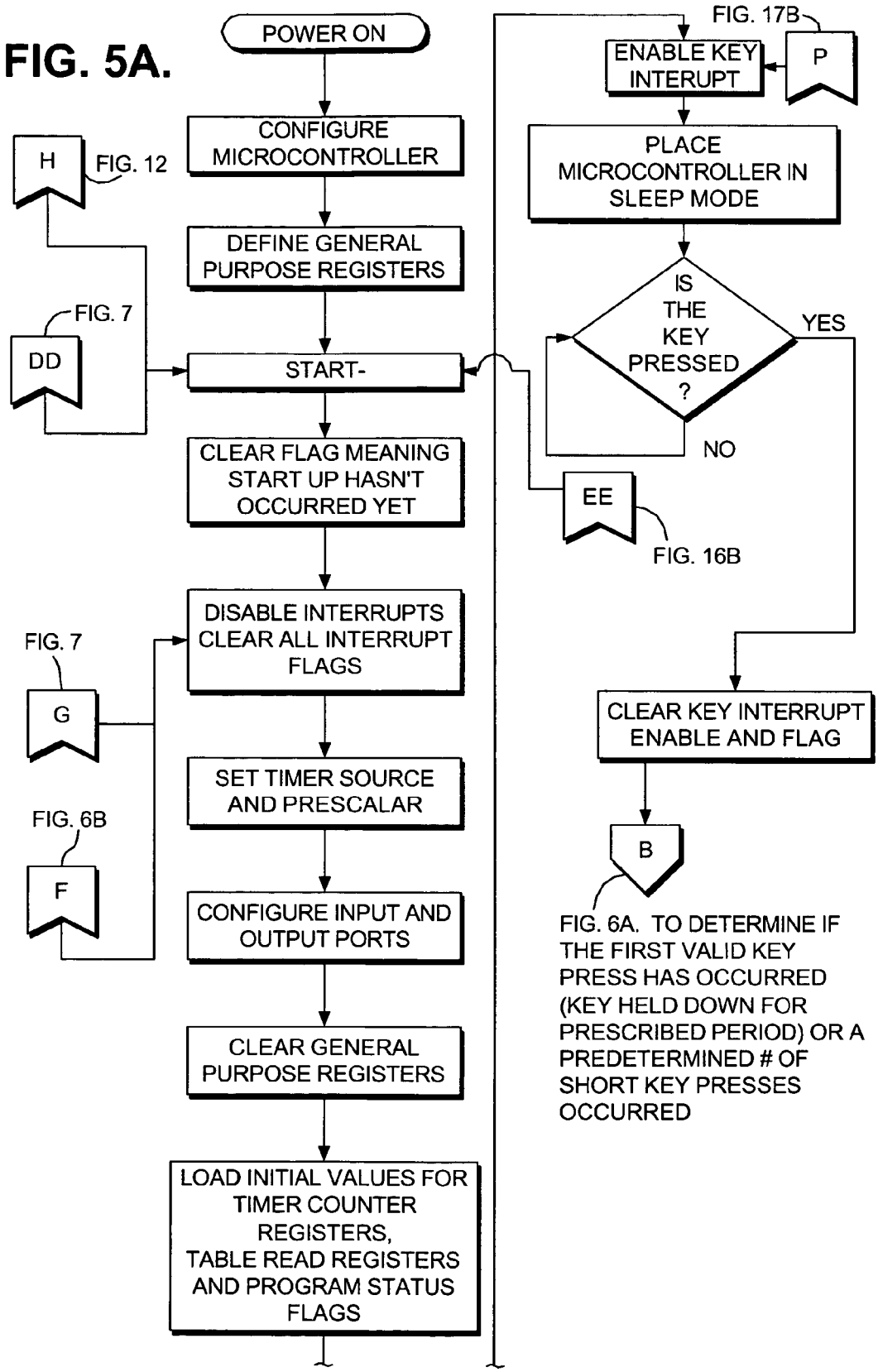
FIG. 5A.
POWER ON
CONFIGURE MICROCONTROLLER
DEFINE GENERAL PURPOSE REGISTERS
START-
CLEAR FLAG MEANING START UP HASN'T OCCURRED YET
DISABLE INTERRUPTS CLEAR ALL INTERRUPT FLAGS
SET TIMER SOURCE AND PRESCALAR
CONFIGURE INPUT AND OUTPUT PORTS
CLEAR GENERAL PURPOSE REGISTERS
LOAD INITIAL VALUES FOR TIMER COUNTER REGISTERS, TABLE READ REGISTERS AND PROGRAM STATUS FLAGS
H
FIG. 12
FIG. 7
DD
FIG. 7
G
FIG. 6B
F
FIG. 17B
P
ENABLE KEY INTERUPT
PLACE MICROCONTROLLER IN SLEEP MODE
IS THE KEY PRESSED ?
YES
NO
EE
FIG. 16B
CLEAR KEY INTERRUPT ENABLE AND FLAG
B
FIG. 6A. TO DETERMINE IF THE FIRST VALID KEY PRESS HAS OCCURRED (KEY HELD DOWN FOR PRESCRIBED PERIOD) OR A PREDETERMINED # OF SHORT KEY PRESSES OCCURRED CLEAR FLAG INDICATING THAT FIRST VALID KEY PRESS HASN'T OCCURRED
IS THE FLAG SET A STARTUP FLAG ? (TO DISCRIMINATE FOR ONE OR MORE INVALID KEY PRESSES)
YES
NO
GO TO ROUTINE TO DISPLAY START UP
A

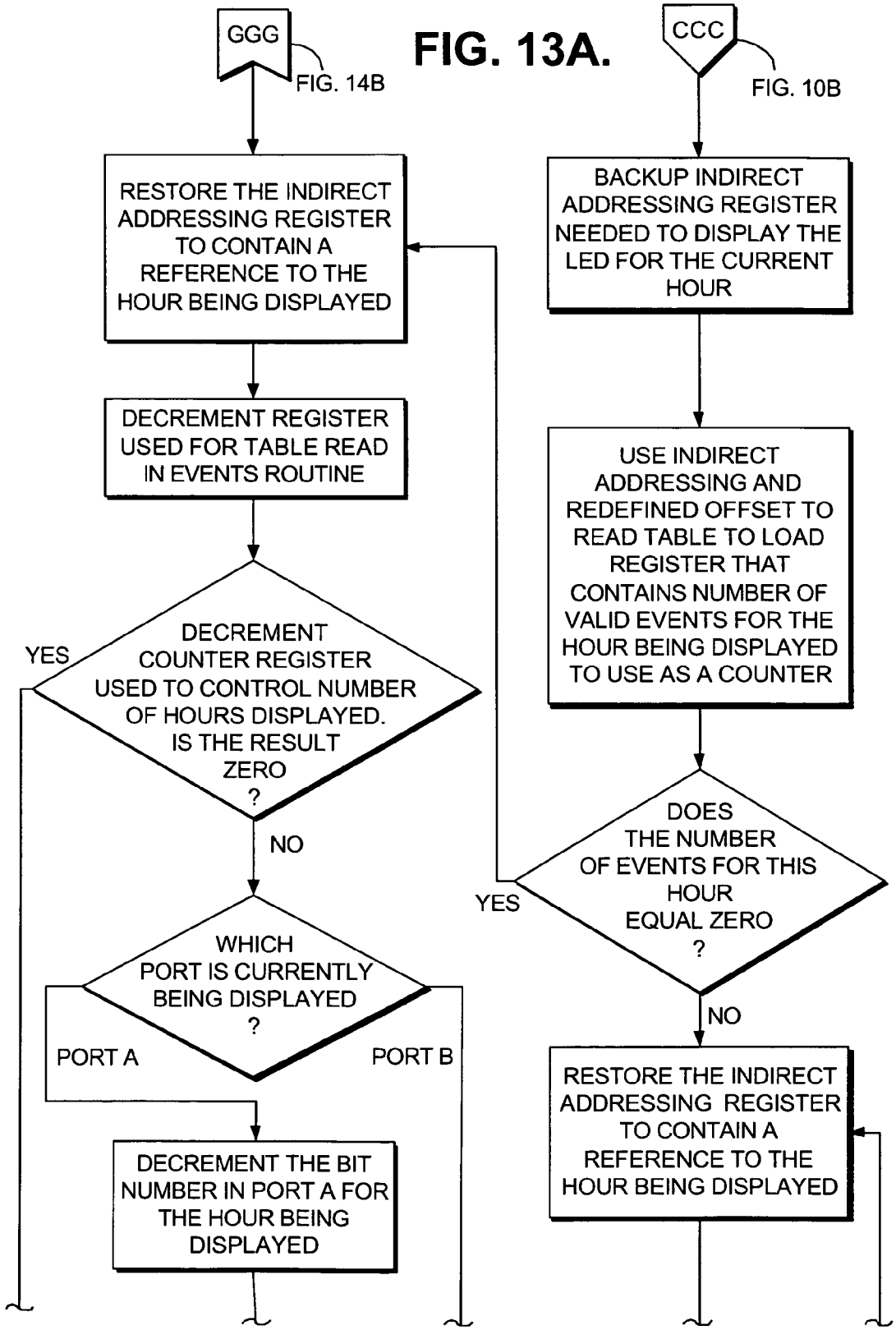
GGG
FIG. 14B
FIG. 13A.
CCC
FIG. 10B
RESTORE THE INDIRECT ADDRESSING REGISTER TO CONTAIN A REFERENCE TO THE HOUR BEING DISPLAYED
BACKUP INDIRECT ADDRESSING REGISTER NEEDED TO DISPLAY THE LED FOR THE CURRENT HOUR
DECREMENT REGISTER USED FOR TABLE READ IN EVENTS ROUTINE
USE INDIRECT ADDRESSING AND REDEFINED OFFSET TO READ TABLE TO LOAD REGISTER THAT CONTAINS NUMBER OF VALID EVENTS FOR THE HOUR BEING DISPLAYED TO USE AS A COUNTER
YES
DECREMENT COUNTER REGISTER USED TO CONTROL NUMBER OF HOURS DISPLAYED. IS THE RESULT ZERO ?
NO
DOES THE NUMBER OF EVENTS FOR THIS HOUR EQUAL ZERO ?
YES
WHICH PORT IS CURRENTLY BEING DISPLAYED ?
PORT A
PORT B
NO
RESTORE THE INDIRECT ADDRESSING REGISTER TO CONTAIN A REFERENCE TO THE HOUR BEING DISPLAYED
DECREMENT THE BIT NUMBER IN PORT A FOR THE HOUR BEING DISPLAYED

HAVE A PRESCRIBED NUMBER OF SHORT PRESSES OCCURRED ?
YES
RESET VECTOR
EE

NO
WAIT A SHORT PERIOD
HAS ANOTHER KEY PRESS OCCURRED ?
YES
NO
DECREMENT THE DELAY LOOP COUNTER
HAVE THE DESIGNATED NUMBER OF DELAY LOOPS OCCURRED WITHOUT ANOTHER KEY PRESS ?
YES
NO
RETURN

METHOD AND APPARATUS FOR MONITORING BREEDING BEHAVIOR

CROSS-REFERENCE TO RELATED APPLICATIONS

This application claims the benefit of U.S. Provisional Patent Application No. 60/488,582 filed on Jul. 17, 2003 and entitled "Method And Apparatus For Monitoring Breeding Behavior" and is expressly incorporated herein, in its entirety, by reference.

STATEMENT REGARDING FEDERALLY SPONSORED RESEARCH OR DEVELOPMENT

Not applicable.

TECHNICAL FIELD

This invention relates to the fields of electronics devices and computer programming. More particularly, it relates to an electronic estrus detection device that stores data based on external stimuli.

BACKGROUND OF THE INVENTION

A pervasive problem that plagues animal breeding is determining the optimum time a female should be inseminated. Breeding bovine animals is made easier when an accurate determination can be made as to when a cow should be artificially inseminated. Generally, cows in heat are near ovulation and let themselves be mounted. Accurately determining when a cow is in heat, and hence should be inseminated, is important because of the scarcity of resources necessary to provide a successful insemination, the expense of those materials, and because the opportunity costs of failed inseminations are great. With respect to bovine animals, millions of dollars worth of semen is wasted each year because of unsuccessful inseminations, the vast majority of which were poorly timed.

Prior attempts have been made to determine when a cow is in heat. In one prior-art method, the animals are simply observed. When mating behavior is observed, a breeder determines whether to act. But such a method is impractical in light of the demands associated with physically observing many animals over long periods of time.

The SHOWHEAT device made by the IMV International Corporation of Minneapolis, Minn. is an exemplary prior-art device that is designed to help determine when a cow is in heat. But, this device makes an actual timing determination. Rather than providing raw data, which a skilled person could include as a factor in determining whether a certain time is the best time to commence insemination, prior-art devices remove the decision-making process from a breeder. Raw data related to recent animal behavior is not provided.

To illustrate this mere one shortcoming of the prior art, consider a group of females outfitted with prior-art devices. In situations where multiple prior-art devices simultaneously indicated that many females are ready for insemination, a breeder would be deprived of valuable information indicating which of the animals should be inseminated first. That is, if a herd of cows were gathered after a certain period of time, and multiple cows were flagged as ready for insemination, prior-art devices merely indicate that at some point the specific cows were ready to be inseminated, if such a determination was accurate. This problem is exacerbated when limited insemination equipment is available. Limited time may require deciding which cows to inseminate first, but the prior-art attempts do not provide a way to retrieve this data.

Another shortcoming of the prior art is the inability to retrieve historical data. This historical data could be used to better understand the mating-behavior events or behavior leading up to ovulation. Without this historical data, a breeder does not have as much information on which to base an insemination decision.

Still another shortcoming of various prior-art attempts is the recordation of false positives. A false positive erroneously indicates that a mount took place. For example, certain ineloquent males or females who lack the mounting prowess of others may fumble while attempting to mount a female. Thus, while attempting to register what should be considered a single successful mount, prior-art devices may erroneously register multiple mounting attempts as actual mounts.

Still another shortcoming of the prior art is that the historical devices are physically large, making them difficult to securely attach to the animal, such as bovine animals. Large devices are also difficult to maintain attached to the bovine animal during mounting behavior.

A final illustrative shortcoming of prior-art devices is the manner in which they provide feedback. Typically, prior-art devices do not provide detailed feedback in such a manner that is easy to observe from a safe or comfortable distance. A dairy farmer may have only a short time frame to read from many devices. Not being able to readily observe indications of mounting behavior or other breeding behavior (especially in its raw format) imposes resource burdens on a breeder.

There is a need for a method and system that more accurately tracks mating-behavior events and presents data related to those events so as to enable a decision maker to determine an optimum insemination time. The prior art could be improved by a device that provides raw data corresponding to mating-behavior events, thereby enabling a more complete, informed insemination decision to be made. The prior art could also be improved by providing a device that logs historical data related to mating behavior leading up to ovulation and that reduces the occurrence of false positives. The state of the art could be improved by providing a device with a sufficiently narrow footprint and low profile that would make attachment and retention to an animal easier and more reliable. Still further, the state of the art could be improved by providing a device that includes only a single actuator (button or switch) for data input.

SUMMARY OF THE INVENTION

The present invention is an electronic device that stores and presents indicators corresponding to animal actions, which may indicate when a female animal is in heat. A reusable, cost-effective, raw-data collection device is provided that times, counts, and records prescribed heat-related actions (such as permitted mounts) and displays the recorded mounting behavior in a simple, easy-to-read format. The invention has several practical applications in the technical arts, not limited to presenting raw data that can be used to determine an optimal window to commence artificial insemination of certain animals. The present invention stores the applicable data for subsequent recall on demand.

In a first aspect, a detection device is provided. The detection device is a self-powered, self-contained device that includes a processing component, a storage component, a counting component, and a data-presentation component.

The device allows for raw-data collection of times and number of valid mounts that a female allows prior to ovulation. As will be explained in greater detail below with reference to a preferred embodiment, the present invention includes a certain number of indicators such as twelve that are used to indicate times at certain intervals, such as hours, of recorded mounting behavior. Data is conveyed using flashing LEDs that can easily be read from a distance. The ability to easily observe recorded mounting behavior is a significant improvement over the prior art. The present invention offers the advantage of a narrow circuit board, approximately 2 cm, making attachment to a cow much easier. Moreover, the present invention includes a relatively low profile (see FIG. 3D). In other embodiments, data can be remotely transmitted to a receiving component.

In another aspect, a method is provided for determining when a female animal is in heat. The method includes tracking the number of mounts a female permits over a period of time. Once the female experiences a mount of preselected duration, such as two seconds, a clock is activated, whereby the present invention begins to display the hour and mounting behavior of the animal. Data validation is performed on input received. In some embodiments, validation takes the form of a mandatory delay interval, whereby subsequent data input received prior to the lapsing of the interval will not be attributed to a mount. Data validation offers the significant benefit of reducing the number of false positives. The behavior is presented by a series of indicators that can be readily observed by a breeder. This ability to display mounting behavior from a distance satisfies a long-felt need of breeders to be able to quickly and accurately observe the mating behavior of cows from a distance. Certain blink durations are employed to convey various data events.

In another aspect of the invention, a computer-program product is provided that tracks preovulation data, such as mounting behavior, and stores it for future recall and/or current presentation. The computer-program product includes embodied computer-useable instructions that monitor mounting behavior, stores the behavior, and presents indicators corresponding to the behavior automatically or on demand.

BRIEF DESCRIPTION OF THE SEVERAL VIEWS OF THE DRAWINGS

The present invention is described in detail below with reference to the attached drawing figures, which are incorporated by reference herein and wherein.

DETAILED DESCRIPTION OF THE INVENTION

Figure 1:
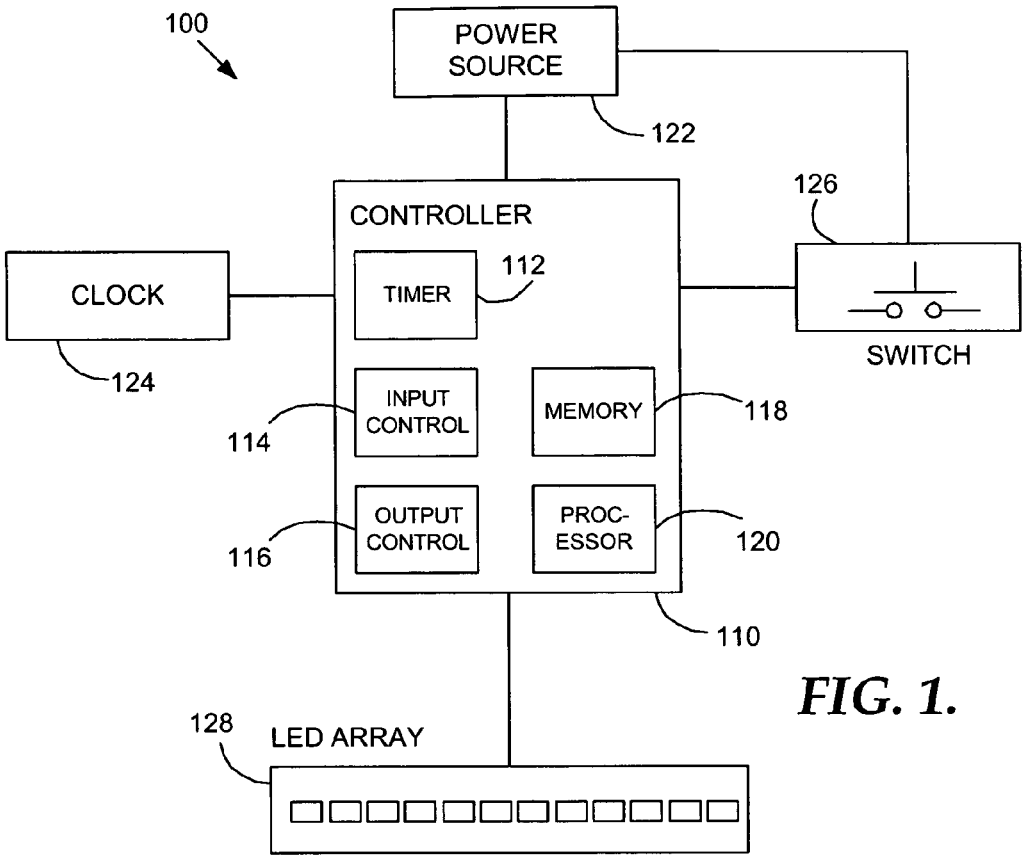
FIG. 1 is a block diagram depicting an illustrative operating environment suitable for practicing the present invention.

The present invention provides an electronic mounting-behavior detection device useful for estimating the optimal time to inseminate animals by recording and displaying mounting behavior related to the estrus cycle, specifically the quantity of mounting events and the elapsed time since each event occurred. The device collects and displays raw data related to permitted mounts. The number of mounts permitted by an animal is stored along with other data during a prescribed period, such as a twelve-hour period. Other periods can be prescribed and are contemplated within the scope of the present invention. Mounting behavior may include one female cow engaging in mounting behavior with another cow, which is sometimes referred to as sympathy mounting. Any mounting behavior, including sympathy mounting, is detected by the present invention. Although the device is described herein with reference to the mounting activities of cows, it to be understood that the invention is also applicable to other animals.

The present invention more accurately tracks mating-behavior events and presents data related to those events, thereby enabling a decision maker to determine an optimum insemination time. The present invention provides raw data corresponding to mating-behavior events. Being able to observe raw data, a breeder can make a more informed insemination decision. The present invention logs historical data related to mating behavior leading up to ovulation and reduces the occurrence of false positives. The present invention provides a narrow footprint that makes attachment to an animal easier and more secure. A low profile greatly helps the present invention stay in place while receiving inputs corresponding to mounting-behavior events.

As one skilled in the art will appreciate, the present invention may be embodied as, among other things, a method, system, or computer-program product. Accordingly, the present invention may take the form of a hardware embodiment, a software embodiment, or an embodiment combining software and hardware. In a preferred embodiment, the present invention takes the form of a computer-program product that includes computer-useable instructions embodied on a computer-readable medium.

Computer-readable media include both volatile and nonvolatile media, and removable and nonremovable media. By way of example, and not limitation, computer-readable media include data-storage media and communications media. Data-storage media, or machine-readable media, include media implemented in any method or technology for storing information. Examples of stored information include computer-useable instructions, data structures, program modules, and other data representations. Computer-storage media include, but are not limited to, RAM, ROM, EEPROM, flash memory or other memory technology, CD-ROM, Digital Versatile Discs (DVD), holographic media or other optical storage devices, magnetic cassettes, magnetic tape, magnetic disk storage, and other magnetic storage devices. These memory components can store data momentarily, temporarily, and/or permanently.

Communications media typically store computer-useable instructions—including data structures and program modules—in a modulated data signal. The term "modulated data signal" refers to a propagated signal that has one or more of its characteristics set or changed to encode information in the signal. An exemplary modulated data signal includes a carrier wave or other transport mechanism. Communications media include any information-delivery media. By way of example but not limitation, communications media include wired media, such as a wired network or direct-wired connection, and wireless media such as acoustic, infrared, radio, microwave, spread-spectrum, and other wireless media technologies. Combinations of the above are included within the scope of computer-readable media.

Turning now to FIG. 1, a block diagram is depicted of an exemplary operating environment 100 suitable for practicing the present invention. Operating environment 100 is provided for illustrative purposes to describe an exemplary embodiment for performing the functionality described in the flow diagrams, which will be described in greater detail with reference to FIGS. 2, 2A, 2B, and 2C. Those skilled in the art will appreciate a variety of alternative operating environments that provide the functional aspects described below. FIG. 1 is illustrative in nature and should not be construed as a limitation of the present invention.

In a preferred embodiment, operating environment 100 includes a controller 110, which may include a timer 112, an input-control component 114, an output-control component 116, a memory 118, and a processor 120. One skilled in the art would recognize alternative names for the aforementioned subcomponents, all of which are not listed nor depicted due to their conventional nature. Timer 112 can receive an incoming clock signal and manipulate the signal to comply with desired parameters and track passage of time. Memory 118 can be, as described above, any computer-readable media for storing and reading computer-useable instructions. Memory 118 is preferably nonvolatile, so as to preserve historical data in the absence of a power source. Processor 120 coordinates data flow through the various subcomponents of controller 110, all of which are not shown due to their conventional nature. Although a litany of devices may be used, exemplary controller 110 suitable for use in the present invention include the PIC16LF627A or PIC16LF84A Microcontroller offered by Microchip Technology Incorporated of Chandler, Ariz.

In a preferred embodiment, controller 110 communicates with a power source 122, an actuator or switch 126, a timing device or clock 124, and a presentation interface such as LED array 128. Power source 122 includes one or more batteries in the preferred embodiment but could be any device that provides power to the system, such as a solar-panel array or a kinetic device that is motion-powered. When used, the batteries are preferably maintained in place with one or more battery holders that are vibration resistant and sufficiently sturdy to withstand vibrations present in manufacturing and in normal use. Clock 124 provides timing functionality to controller 110. Switch 126 can be any type of actuating device that signals the happening of an event. In some embodiments, the entire casing (described in greater detail below with reference to FIGS. 3A-3I) that houses the electronics of the device can trigger switch 126 in a pressure-sensitive embodiment. Thus the casing can act as a switch. This embodiment is useful to increase the surface area available to receive mounting-behavior stimuli. Switch 126 can be normally opened or normally closed and can be in the form of a hardware embodiment or software embodiment, such as a proximity sensor. A single-button embodiment makes the present invention easier to operate. Control over device functionality can be achieved by deliberate sequencing of switch 126, sequencing that would not likely be caused by an animal.

Figure 1A:
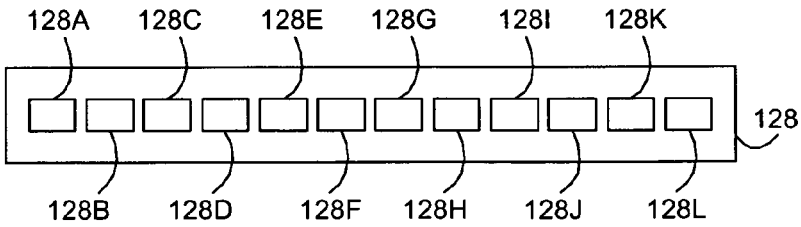
FIG. 1A is an enlarged view of a first exemplary LED array in accordance with an embodiment of the present invention.

Presentation interface 128 provides mounting-behavior feedback to an observer. Typically, the observer will be a human being, but an observer could be an inanimate device, such as a light-reading device that can read the data gathered by the present invention. In a preferred embodiment, the presentation interface 128 is an array of LEDs. But presentation interface 128 may also include one or more audio-generating components such as a speaker. The LEDs, however, provide easy-to-read feedback that is readily observable by an observer. Although the number of LEDs can vary, the preferred embodiment uses twelve LEDs wherein each LED corresponds to a one-hour interval. This embodiment is illustrated in FIG. 1A, which depicts twelve individual LEDs referenced by numerals 128A-128L. The LEDs blink according to a programmable pattern to indicate input received. Input reception can be triggered by a variety of events including mounting behavior. The LEDs 128A-128L need not be the same color and may even each be multicolored. LEDs 128A-128L are preferably a flat rectangular type rather than the round cylindrical type. Although the round cylindrical type can be used, flat LEDs offer a slimmer design.

Figure 1B:
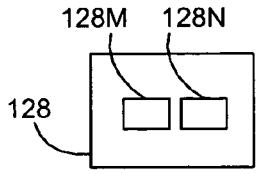
FIG. 1B is an enlarged view of a second exemplary LED array in accordance with an embodiment of the present invention.

An alternative embodiment is shown in FIG. 1B where LED array 128 includes two LEDs 128M and 128N, each of a different color. In this embodiment, a first LED 128M blinks to convey time and the second LED 128N blinks to convey mounting behavior for the corresponding time segment. These two exemplary embodiments provide the same benefit of being able to read the device at a safe or comfortable distance from the animal. But presentation interface 128 does not necessarily have to be an LED array, as long as the interface enables distant observation of recorded mounting behavior. The remaining disclosure, however, will describe the invention with respect to a preferred embodiment of twelve LEDs for ease of explanation.

Figure 2:
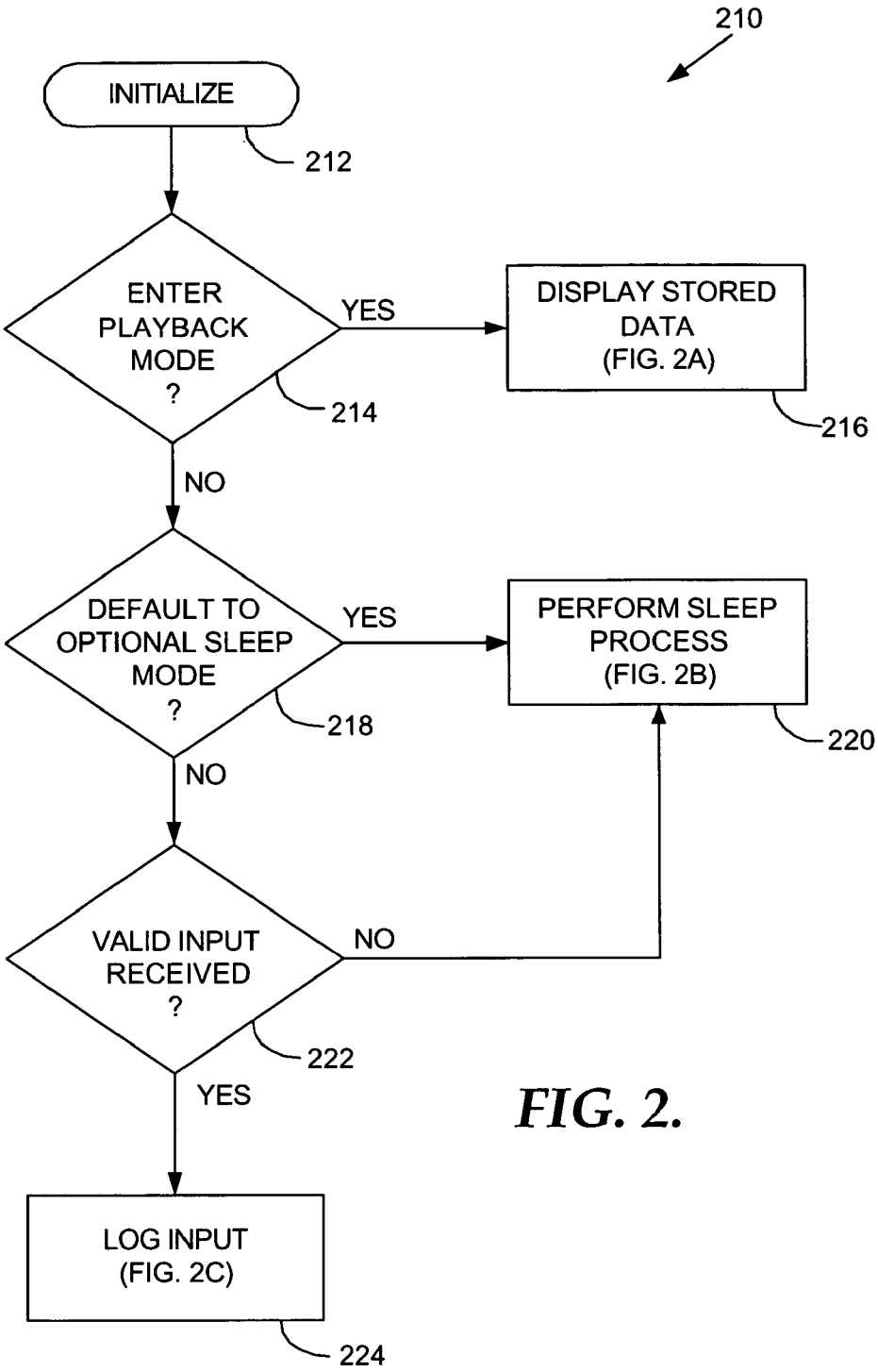
FIG. 2 is a flow diagram illustrating a method for presenting mounting and recording behavior in accordance with an embodiment of the present invention.

Turning now to FIG. 2, a flow diagram of an embodiment of the present invention is referenced generally by numeral 210. Not all steps are necessary steps and the order of processes described should not be interpreted limitations of the invention. On power up or incident to a reset, the present invention can conduct an initialization process at a step 212. A variety of tasks can be performed during initialization. In one embodiment, the LED array 128 is cycled at initialization step 212 to provide visual confirmation that each LED is functioning properly. Timer 112 is reset and allocations are made in memory 118 to record a new input cycle.

A playback mode is offered by the present invention to display historical data. Playback mode retrieves data stored in memory 118 and presents the data to a user. Additional memory may be provided to store more data. A more informed decision can be made with the benefit of historical data. Using the present invention, a veterinarian can observe prior mating-behavior events and decide what type of insemination procedures to facilitate. Playback mode can be triggered at a step 214. If it is, the stored data is displayed at a step 216, which will be described in greater detail with reference to FIG. 2A.

If playback mode is not entered then an optional sleep mode may be defaulted to at a step 218. This optional feature prolongs battery life and is exited when valid input is received. In a preferred embodiment, sleep mode is the default mode. If no action is taken, then sleep mode is entered at a step 220, which will be explained in greater detail with reference to FIG. 2B. The present invention waits for valid input (which could be a reset sequence) to be received, indicated by a step 222. When valid input is received it is logged at a step 224, explained in more detail with reference to FIG. 2C. In a preferred embodiment, input is received via switch 126, which could be the entire housing.

Figure 2A:
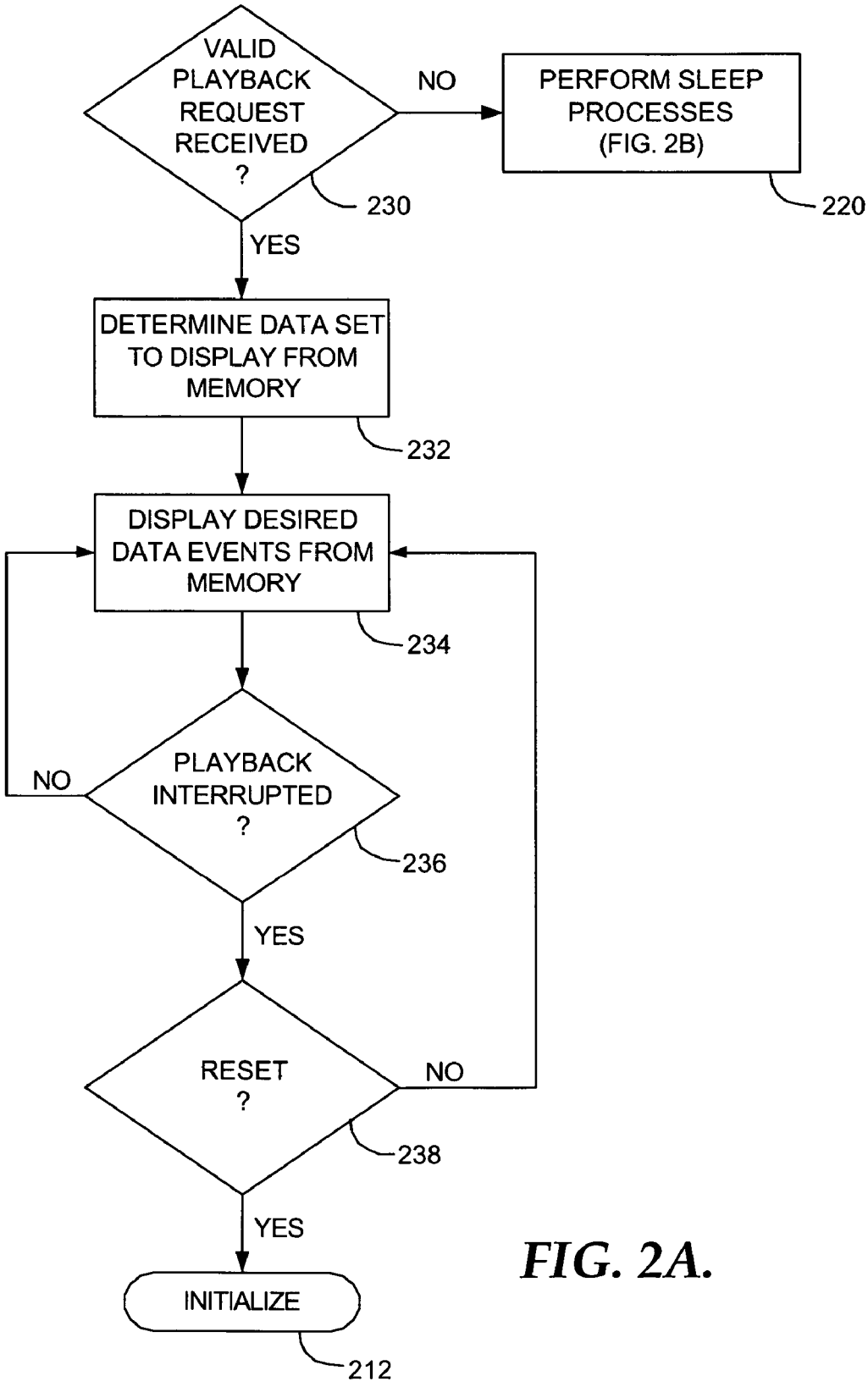
FIG. 2A is a flow diagram illustrating in greater detail a method for recalling and displaying logged mounting behavior in accordance with an embodiment of the present invention.

Turning now to FIG. 2A, a more detailed flowchart is provided that describes an embodiment of the playback mode. At a step 230, a determination is made as to whether a valid playback request is received. If a valid playback request is not received, sleep process 220 continues. In a preferred embodiment, a valid playback request corresponds to a prescribed sequence of inputs received via switch 126. In one embodiment, for example, the number of presses of switch 126 during initialization will present a corresponding data series. Thus, if switch 126 is pressed a certain number of times—for instance, five times—during the initialization cycle 212 (which is preferably indicated by two sequencings of LED array 128), then the fifth most recent data cycle will be displayed. How the data is displayed can vary, but LEDs 128A-128L deliberately blink in a prescribed pattern. An exemplary prescribed pattern will be described in greater detail below.

At a step 232, controller 110 determines the correct data set to display from memory 118. In the embodiment described immediately above, controller 110 receives the number of switch presses. One press will retrieve the most recently stored data. Two presses will retrieve the second most recently stored data and so forth. The desired data events are displayed at a step 234. The method explained to retrieve historical data should not be construed as a limitation of the present invention. Historical data could be retrieved in a variety of ways; successive switch presses during a specific time is but one way. Some embodiments may use a separate switch to retrieve stored data. Other embodiments may present previous cycles by holding down switch 126. The ability to retrieve stored data is more important than the way the data is actually retrieved.

Playback of historical data may be interrupted at a step 236 by receiving another input stimulus. If playback is not interrupted, then historical data is persistently presented to a user. But if additional input is received, then a determination is made at a step 238 as to whether a valid reset request has been submitted. A valid reset request should require deliberate action. In a preferred embodiment, a reset request is triggered by five successive presses of switch 126. In other embodiments, switch 126 may be pressed four times, or ten times, etc. In embodiments that have multiple switches, one of the switches can be dedicated to perform a reset function. In still other embodiments, a magnet can be used in connection with an appropriate switch to reset the device. If a valid reset request is received, the present invention reinitializes at a step 212.

Figure 2B:
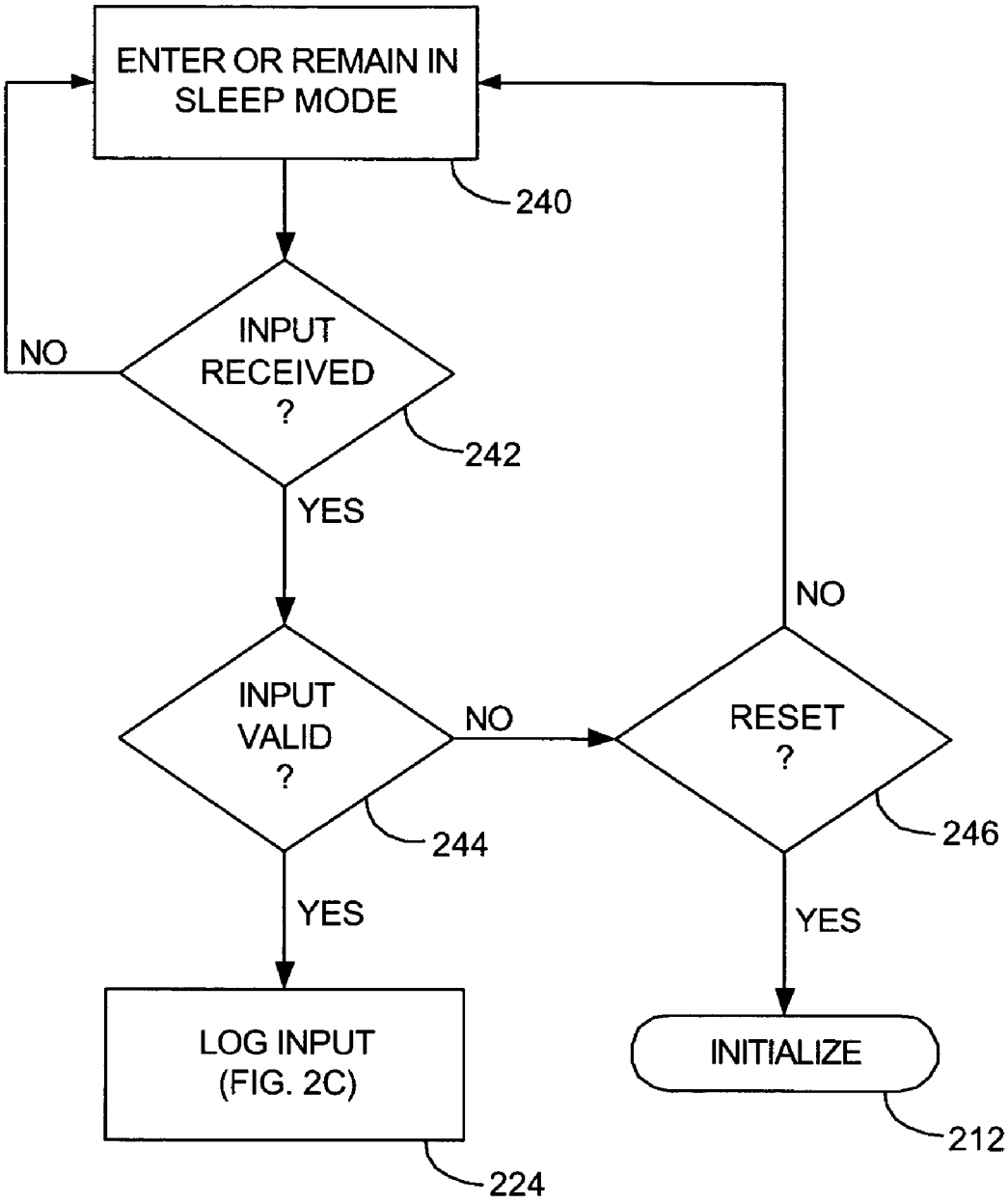
FIG. 2B is a flow diagram illustrating in greater detail a method for engaging a sleep mode in accordance with an embodiment of the present invention.

FIG. 2B more particularly illustrates the sleep mode. Sleep mode is a mode whereby a minimal amount of energy is used by the present invention. At a step 240, sleep mode is either initiated or maintained. If no input is received, the system remains in sleep mode, as indicated by step 242. But if input is received, then a determination is made at a step 244 as to whether the input is valid.

This first validation is provided to reduce false starts and is programmable. In a preferred embodiment, the input received passes validation if switch 126 remains closed for approximately two or three seconds. If the device is attached to an animal, such as a cow, it may be triggered by a variety of events. The main event sought to be tracked by the present invention is a mount permitted by a female animal. A two-second depression of switch 126 would most likely be caused by a successful mount. Any time interval may be used to suit an array of applications. But requiring some sort of minimum switch-depression interval reduces the likelihoods of false positives, recorded events that do not actually correspond to an attempted mount. If the input is valid, then it is logged at a step 224. If it is not valid, then a determination is made as to whether the input may be a reset request at a step 246. If not, then sleep mode is maintained at a step 240, but if the input provides a valid reset request, then the system is initialized at a step 212.

Figure 2C:
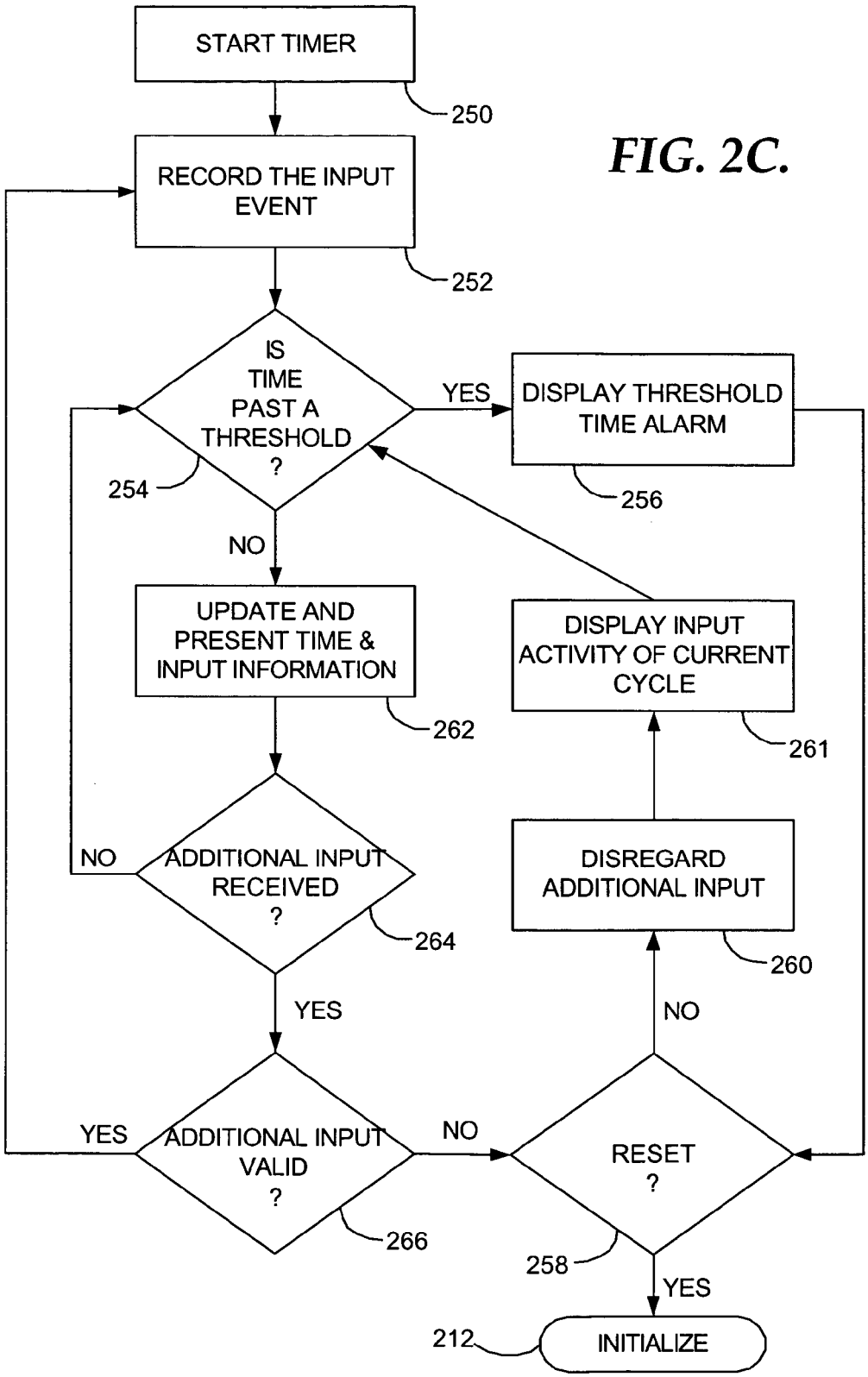
FIG. 2C is a flow diagram illustrating in greater detail a method for receiving and presenting mounting behavior in accordance with an embodiment of the present invention.

FIG. 2C is a flow diagram depicting a preferred embodiment of how the present invention logs data. When a valid input is initially received, a timer is started at a step 250. The timer can be timer 112 or any device that tracks the passage of time. The input event is recorded at a step 252 by storing the time and event in memory 118. After the event is recorded, a determination can be made as to whether a cycle threshold has lapsed at a step 254. The cycle threshold is a programmable maximum time interval during which data is received for tracking purposes. In a preferred embodiment, the cycle threshold is twelve hours. Although variable, this threshold is preferable because some research suggests that artificial insemination is most likely to be successful if done approximately 12 hours after the first standing heat. Moreover, 12 hours approximately coincides with the milking cycle of some dairy cows. Although other periods such as 8 hours (or any duration) are also applicable and contemplated within the scope of the present invention. During the milking cycle, a farmer may either outfit cows with the present invention or observe the data provided by the present invention to make artificial-insemination decisions. This cycle can be varied according to the type of animal the present invention is to be used in connection with.

If the threshold has lapsed, then a threshold time alarm is presented at a step 256. This alarm can take a variety of forms and may even be omitted. But in one embodiment, the first LED 128A and last LED 128L flash in rapid succession, providing a clear indication to a breeder that the current recording cycle is complete. If a valid reset request is received at a step 258, then the system reinitializes it at a step 212. Otherwise, subsequent input is disregarded at a step 260, and the input behavior of the current cycle is displayed persistently.

If the prescribed cycle threshold has not lapsed at a step 254, then controller 110 updates by storing the event in memory 118. The update is immediately reflected by LED array 128. Thus, the hour and mounting behavior are immediately and easily observable. As will be described in greater detail below with reference to a preferred embodiment, a long blink designates the hour and short blinks designate the number of valid inputs—mounts in this example—in that hour. Input could be tracked by the half hour or any other time horizon; hourly tracking is merely exemplary. Additional input may be received at a step 264. If no input is received, the present invention continues displaying input data until the cycle threshold time passes. But if additional input is received, then it is validated at a step 266.

One of the many benefits of the present invention is its ability to reduce the occurrence of false positives. A false positive would be a recorded event that should not have been logged. In operation, a false positive may be generated by an animal pursuing a mount, but who merely strikes the device occasionally while attempting the mount. To reduce the occurrence of false positives, the data is validated at a step 266. In a preferred embodiment, validation includes the occurrence of two events: first, that switch 126 remain closed for a threshold duration (two seconds for example) and second, that a prescribed interval (such as three seconds) lapsed between successive input receptions. That is, switch 126 must be closed for approximately two seconds after having been open for approximately three seconds in this embodiment. The two- and three-second thresholds are exemplary in nature and should not be construed as a limitation of the present invention. There may be many hundreds of different validation techniques that can be used in lieu of the described method. What is important is including a validation step, such as step 266. Although even the validation step can be eliminated without departing from the scope of the present invention, doing so would most likely result in less accurate data.

A novel aspect of the present invention is providing detailed feedback to a breeder using readily observable flashing lights (LEDs) blinking in a pattern composed of long and short flashes in a preferred embodiment. The actual sequencing can vary. What follows is a description of merely one example to sequence the LEDs of array 128 to present stored data. In the preferred embodiment, long blinks designate the hour—according to the respective flash LED—and short blinks designate the input events (hereafter "mounts"). Only one LED is active at any given time to ease reading. An illustrative example follows.

The first standing mount will cause first LED 128A to blink in a certain manner. In this embodiment, the first LED will blink one long blink to indicate the hour and one short blink to indicate the standing mount. Thus, a breeder observing the device would understand that hour one is being recorded and that one mount or attempted mount has taken place in that hour. If the animal accepts another mount in hour one, then LED 128A will blink one long blink (still indicating that mounts are being recorded for hour one, the first hour) and two short blinks (indicating that two mounts have taken place in that hour). After the first hour lapses, cycling extends to the next LED, whereby LED 128B will begin to blink—one long blink. If the cow or other animal permits a mount in the second hour, then that mount will be indicated by one short blink of LED 128B. This information is persistently presented. A breeder would observe the first LED blink once long, followed by two shorts, followed by a long blink from the second LED and then one short blink of the second LED. The cycle would then repeat. After the second hour completes, the third LED 128C will begin to blink one long blink. This process will continue for the prescribed cycle duration, such as twelve hours.

In this embodiment, the total number of short blinks corresponds to the total number of mounts. But the present invention will also provide an indication of the peak mounting period. Assuming a cow's optimal breeding window occurs approximately twelve hours after its first mount, a breeder may simply wait until the threshold-cycle alarm is presented. That cow can then be inseminated. With access to raw data—more data than a mount indication—a breeder can distinguish valid mounting activity from other activity and better predict optimal time for insemination, including consideration of variables such as the period of peak mounting activity or the past behavior of the particular cow in question.

Figure 3A:
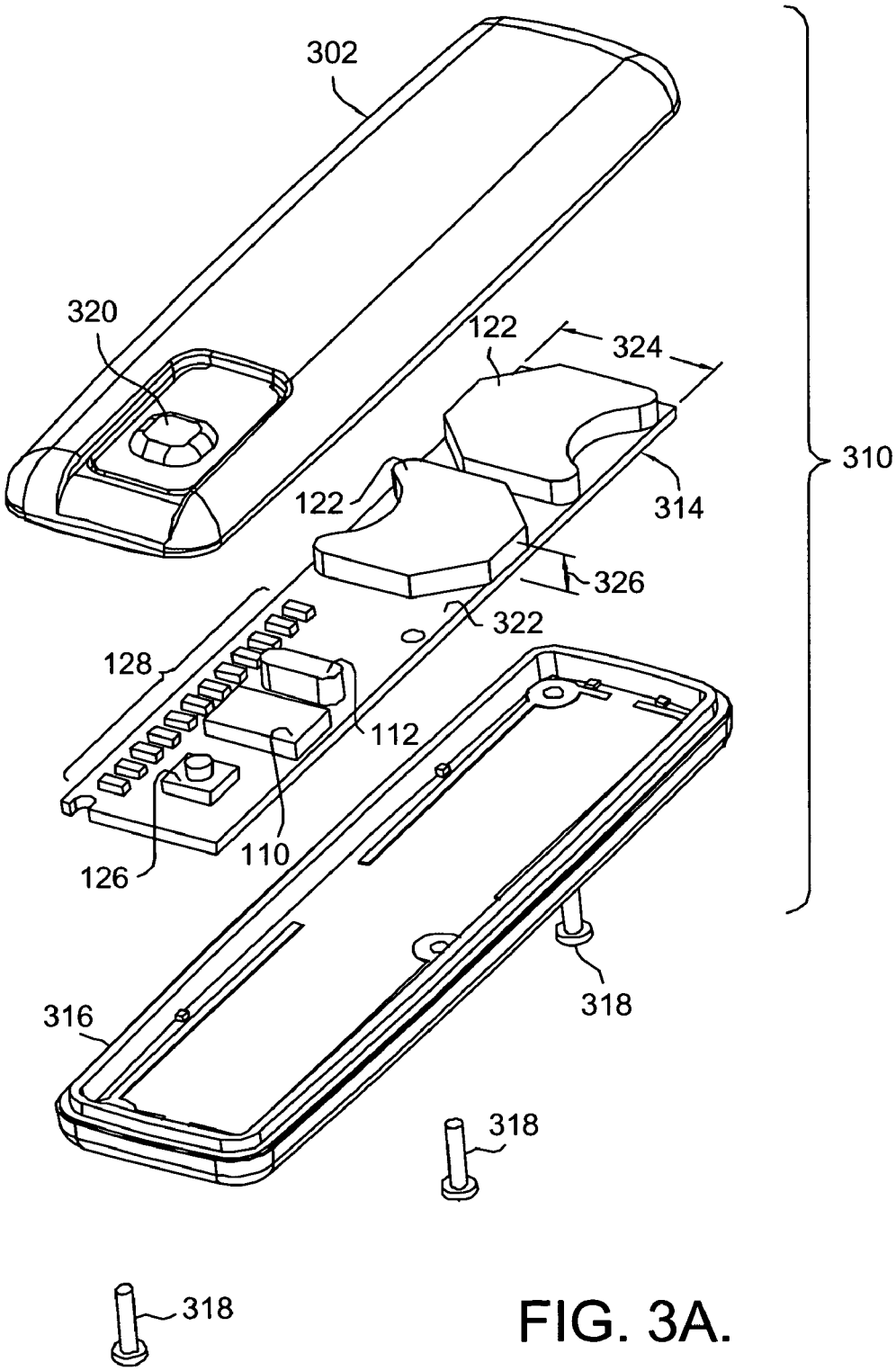
FIG. 3A illustrates an exploded view of exemplary physical components in accordance with an embodiment of the present invention.

FIG. 3A is an exploded view of physical characteristics of a preferred embodiment of the present invention. The detection device is referenced generally by the numeral 310 and includes an upper casing 302, electronics console 314, and lower casing 316. Upper casing 302, in conjunction with lower casing 316, encloses electronics console 314. Casings 302 and 316 are made of a polycarbonate material, or another suitable material capable of maintaining its structural integrity while bearing the weight of a mounting animal.

Upper casing 302 is preferably transparent or translucent so that flashes of LED array 128 can be easily observed through the case, as well as through a transparent sleeve that is affixed to the animal and adapted to receive device 310. In other embodiments, a window may be provided to enhance observability of LED array 128 (see FIG. 3F). In both cases, the present invention offers the desirable aspect of presenting mounting data in a readily observable manner. Upper casing 302 is generally rectangular in shape with beveled edges to minimize catching of the device on the mounting animal or other objects. Upper casing 302 can include a seal to prevent moisture and matter from entering into the device and a durable push-button cover 320 for activating switch 126. Push-button cover 320 may be made of the same material as the seal or another suitable material capable of repeatedly withstanding the weight of the mounting animal and returning to an initial position.

In an alternative embodiment, upper housing 302 and lower housing 316 work together to trigger switch 126. In this embodiment, there is no push button 320. In its stead, the casing as a whole transitions from a first position to a second position during a mounting event. After the mounting event, the device 310 returns to its first position.

Lower casing 316 is adapted to receive the upper casing 302. A suitable set of fasteners 318 secure the casings together and can withstand the weight of the mounting animal and other conventional wear and tear. Fasteners 318 may be screws. The size of the casings, and the device 310 as a whole, is preferably minimized to reduce catching of the device on the mounting cow or other objects.

As previously explained, one skilled in the art would appreciate a variety of components and arrangement of components that may be used to provide the functionality of the present invention. Electronics console 314 is but one example. It illustrates an arrangement of components on a printed circuit board (PCB) 322. Affixed to PCB 322 in this embodiment is LED array 128, switch 126, controller 110, clock 112, and two replaceable batteries 122. Two batteries are not necessary but provide extended power. As shown, the layout enables PCB 322 to have a width 324 of approximately two centimeters, a height 326 of less that six millimeters, and length of less than ten centimeters. Without the second battery 122, PCB 322 can be only 7.5 cm long. The small footprint of PCB 322 reduces the overall width of the device 310, offering a significant advantage of making attachment to a cow's tailbone more stable and secure. The components of electronics console 314 can preferably be coated with a water-resistant material to increase reliability.

Figure 3B:
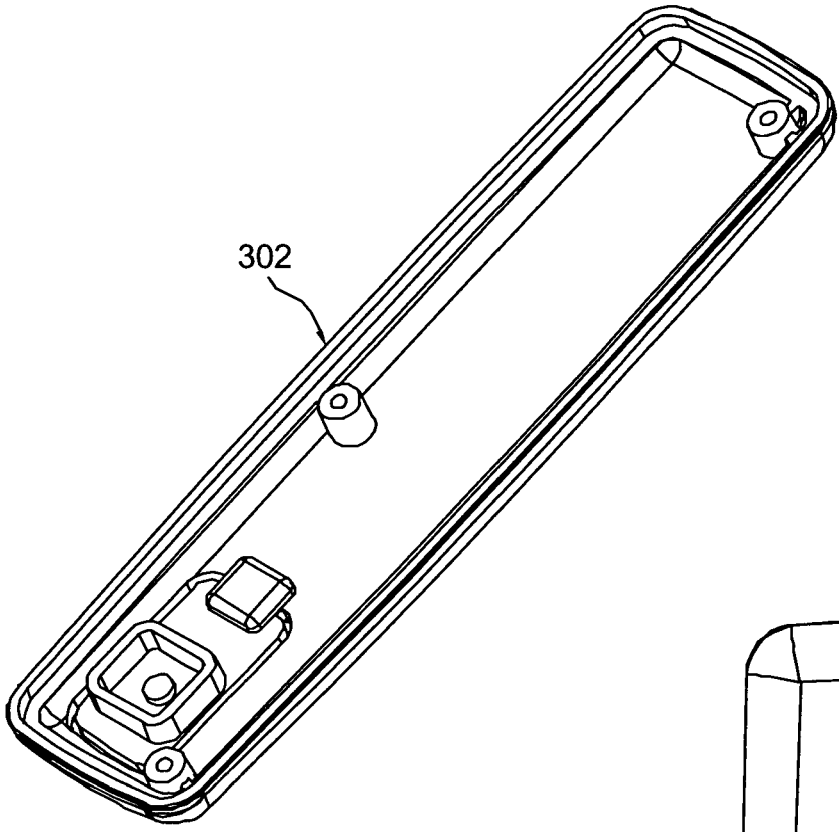
FIG. 3B illustrates an exemplary underside of the upper casing shown in FIG. 3A in accordance with an embodiment of the present invention.
Figure 3C:
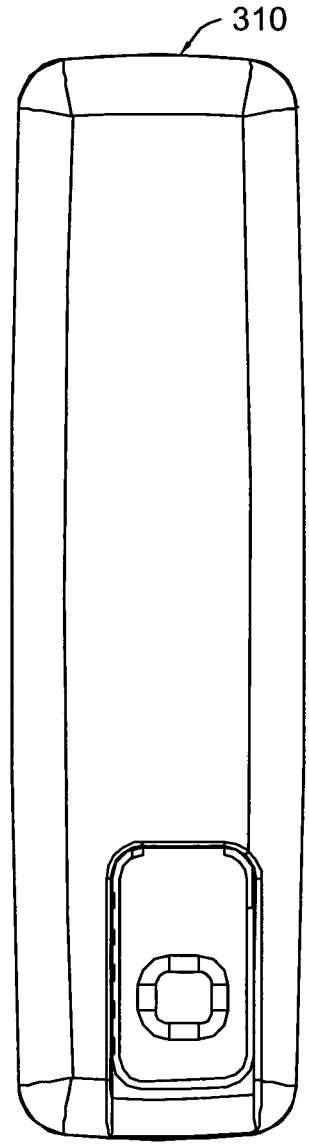
FIG. 3C illustrates an elevated view of the housing shown in FIG. 3A in accordance with an embodiment of the present invention.
Figure 3D:
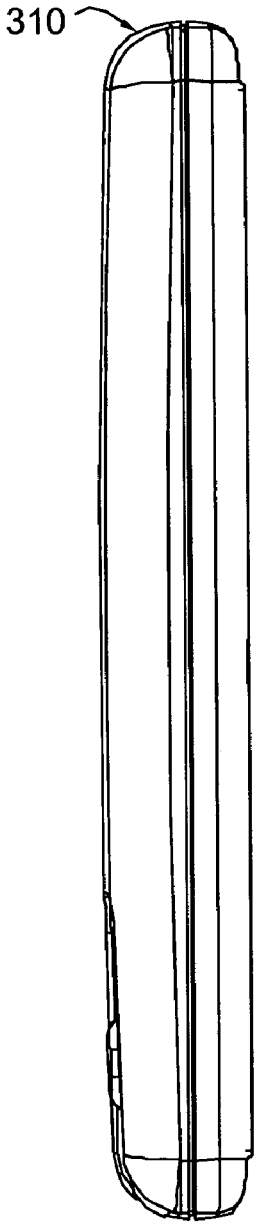
FIG. 3D illustrates a side view of the housing shown in FIG. 3A in accordance with an embodiment of the present invention.
Figure 3E:
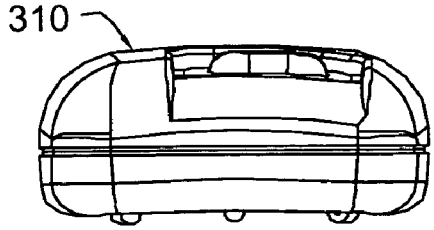
FIG. 3E illustrates an end view of the housing shown in FIG. 3A in accordance with an embodiment of the present invention.

FIG. 3B illustrates the underside of upper casing 302. FIG. 3C is a top or elevated view of detection device 310. Note that in some embodiments, a window or series of perforations can be included to increase the visibility of the LEDs of LED array 128. FIG. 3D provides a side view of detection device 310, illustrating the relatively low profile of the present invention that helps it to stay in place while in use. FIG. 3E provides an end view of detection device 310.

Figure 3F:
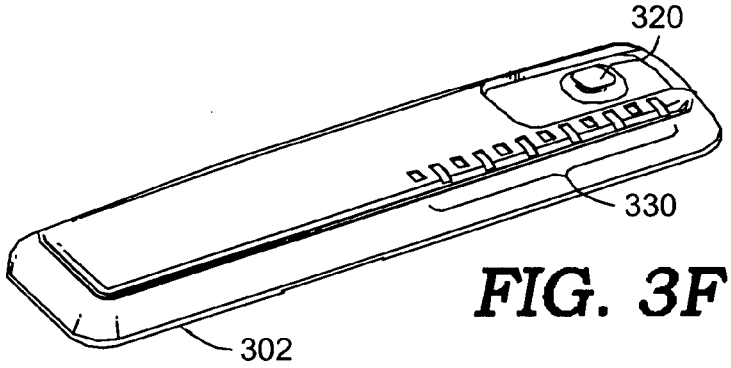
FIG. 3F is an additional outside view of the upper portion of the housing of FIG. 3A in accordance with an embodiment of the present invention.
Figure 3G:
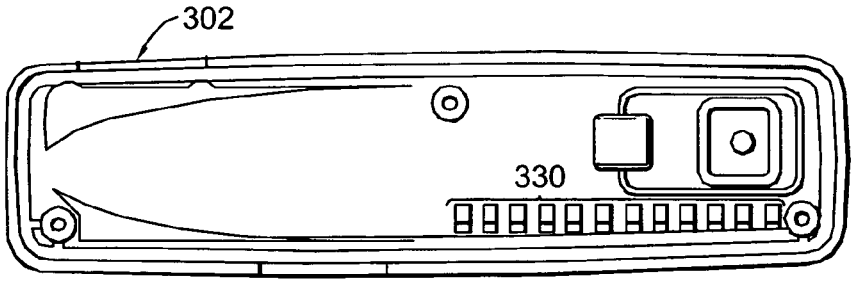
FIG. 3G is an additional inside view of the upper portion of the housing of FIG. 3A in accordance with an embodiment of the present invention.
Figure 3H:
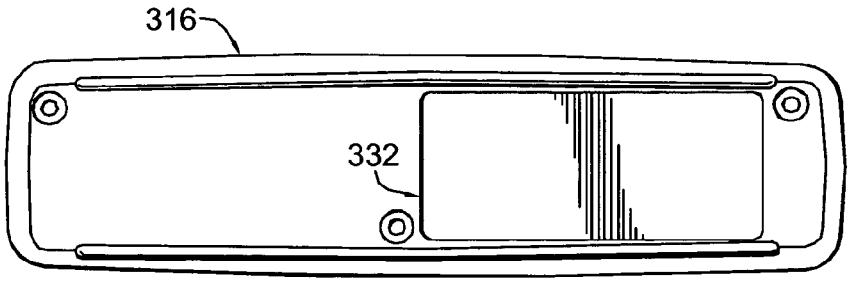
FIG. 3H is an outside view of the lower portion of the housing of FIG. 3A in accordance with an embodiment of the present invention.
Figure 3I:
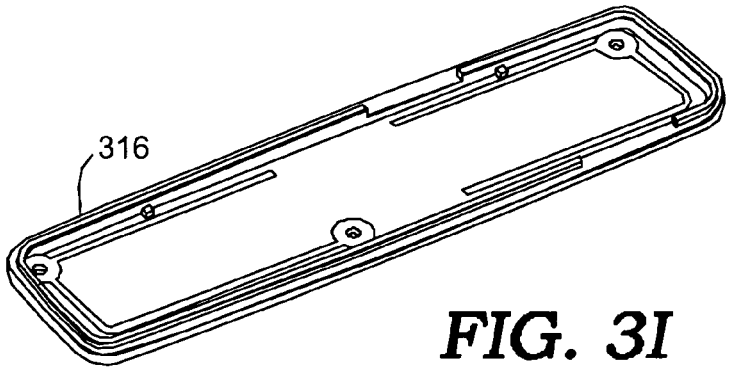
FIG. 3I is an additional inside view of the lower portion of the housing of FIG. 3A in accordance with an embodiment of the present invention.

Turning now to FIG. 3F, an additional outside view of top housing 302 is according to an embodiment of the present invention. Although push-button cover 320 is shown, other actuators may be employed as previously described. In some embodiments, the entire cover shown in FIG. 3F may itself trigger actuator 126. An LED window array 330 is an alternative to a transparent or translucent housing 302. LED window array 330 may be also take the form of a slit in housing 302 rather than the set of individual windows shown. An inside view of top housing 302 is provided in FIG. 3G Turning now to FIG. 3H, an outside view of lower housing 316 is provided. Attachment to an animal is preferably made by affixing a sleeve to the animal that receives the detection device 310. FIG. 31 is an additional inside view of the lower housing 316 according to one embodiment of the present invention.

Figure 4:
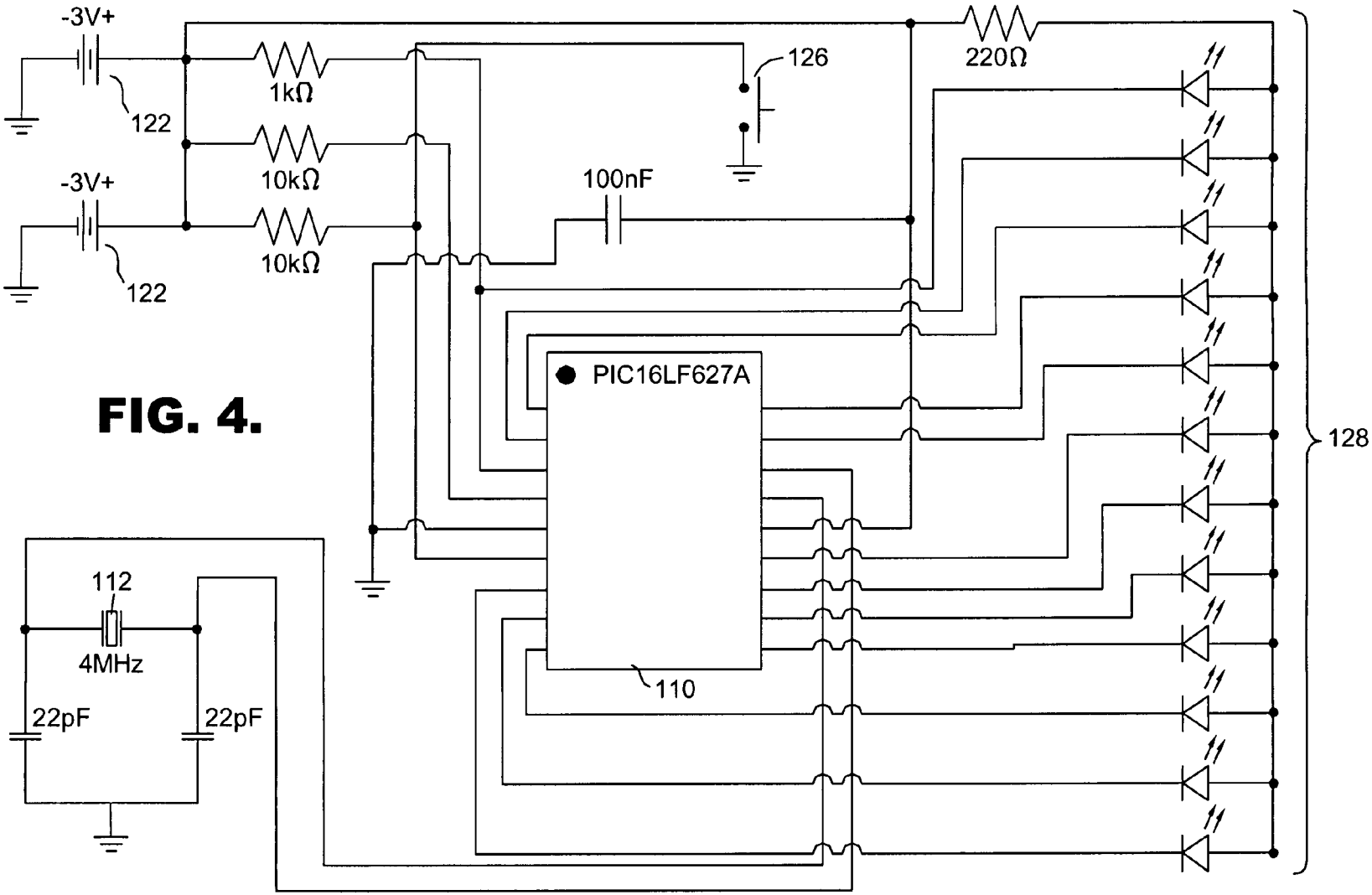
FIG. 4 is a schematic wiring diagram illustrating one of many alternative arrangements of components that will facilitate the functionality described in accordance with an embodiment of the present invention.
Figures 5B, 17A:
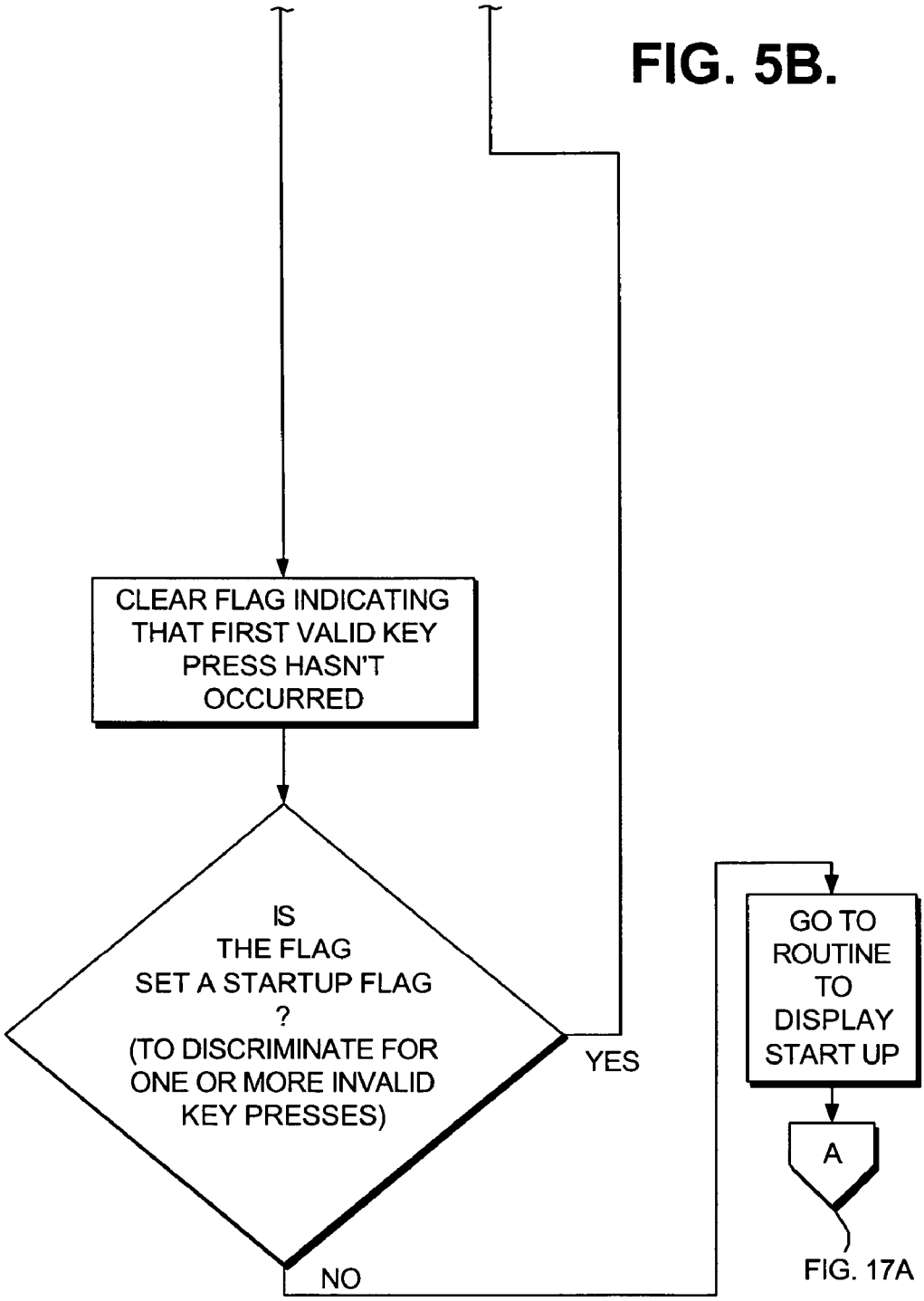
FIGS. 5A-27 compose a detailed flow diagram for receiving and presenting mounting-behavior data in accordance with one embodiment of the present invention.
Figure 6A:
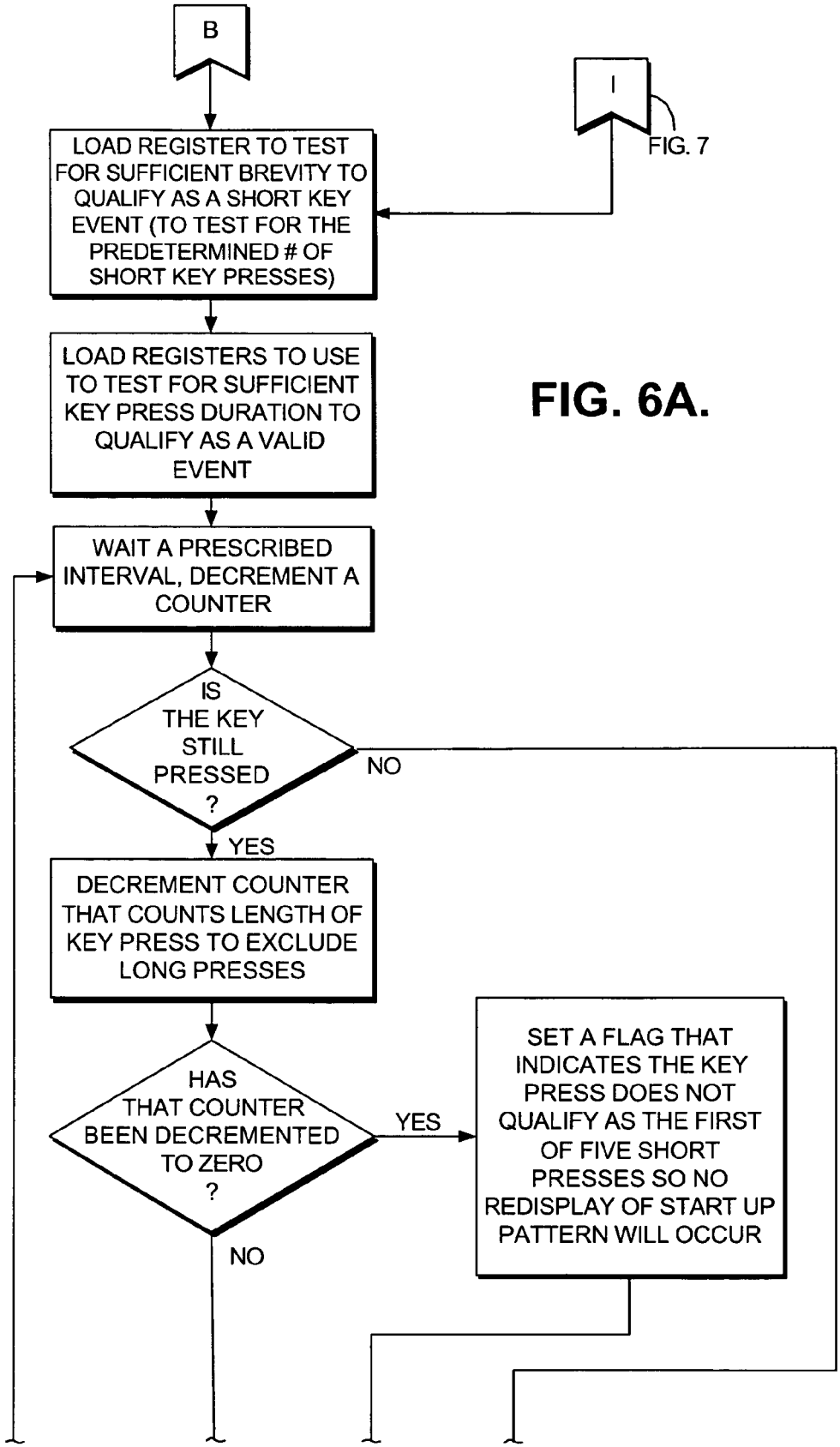
Figure 6B:
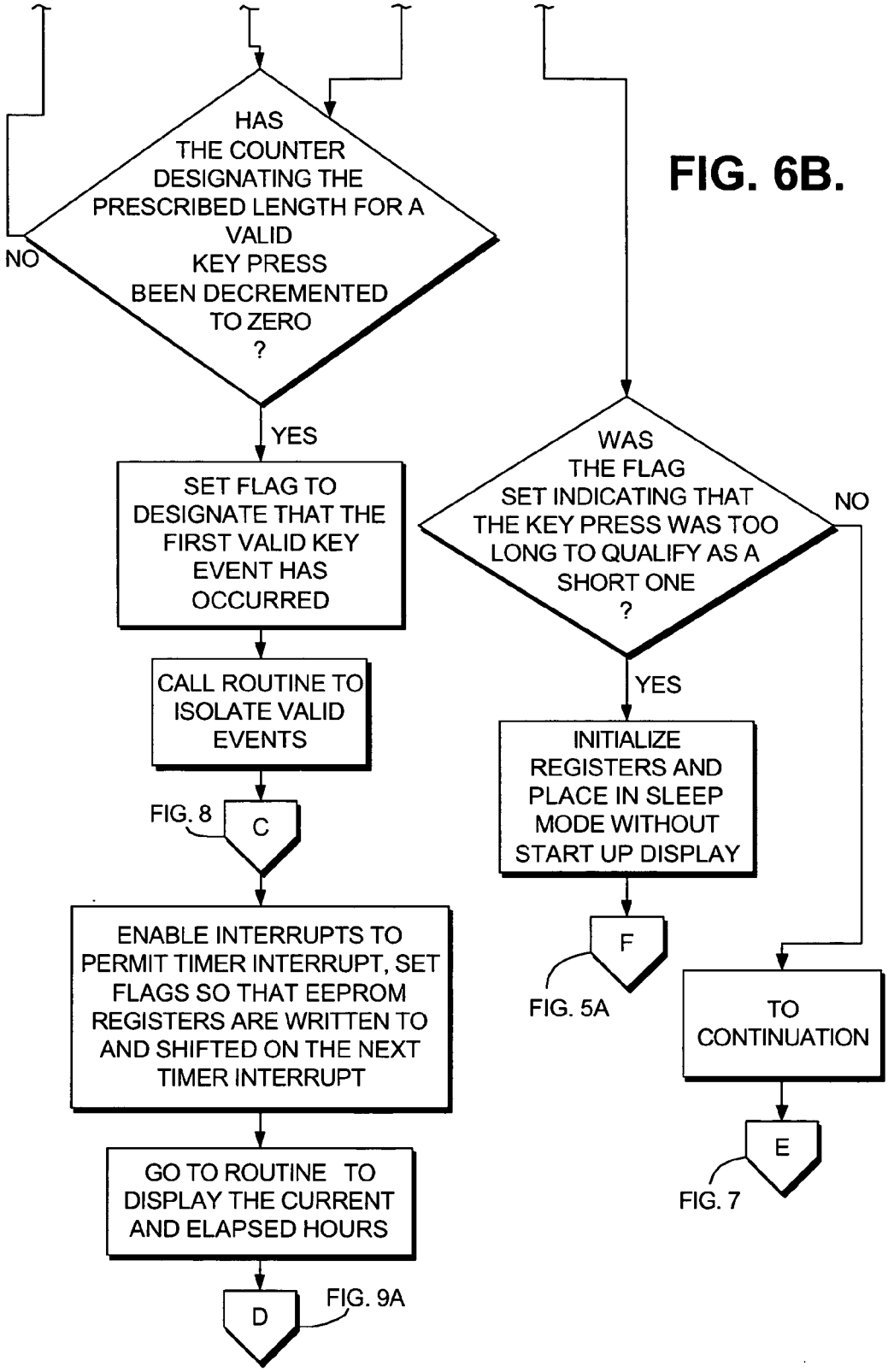

FIG. 4 is a wiring diagram of but one arrangement of components that accomplish the aforementioned functionality. The diagram of FIG. 4 should not be construed as a limitation of the present invention because different electrical components could be arranged in different ways to accomplish the same results as those described herein. Those skilled in the art will appreciate reading the diagram of FIG. 4 in connection with the components of FIG. 3A to make and use the invention. Although controller 110 is illustratively depicts the PIC16LF27A microcontroller, other suitable devices, such as the PIC16LF84A (both offered by Microchip Technology Incorporated of Chandler, Ariz. as previously mentioned), would also provide the functionality desired.

Figure 7:
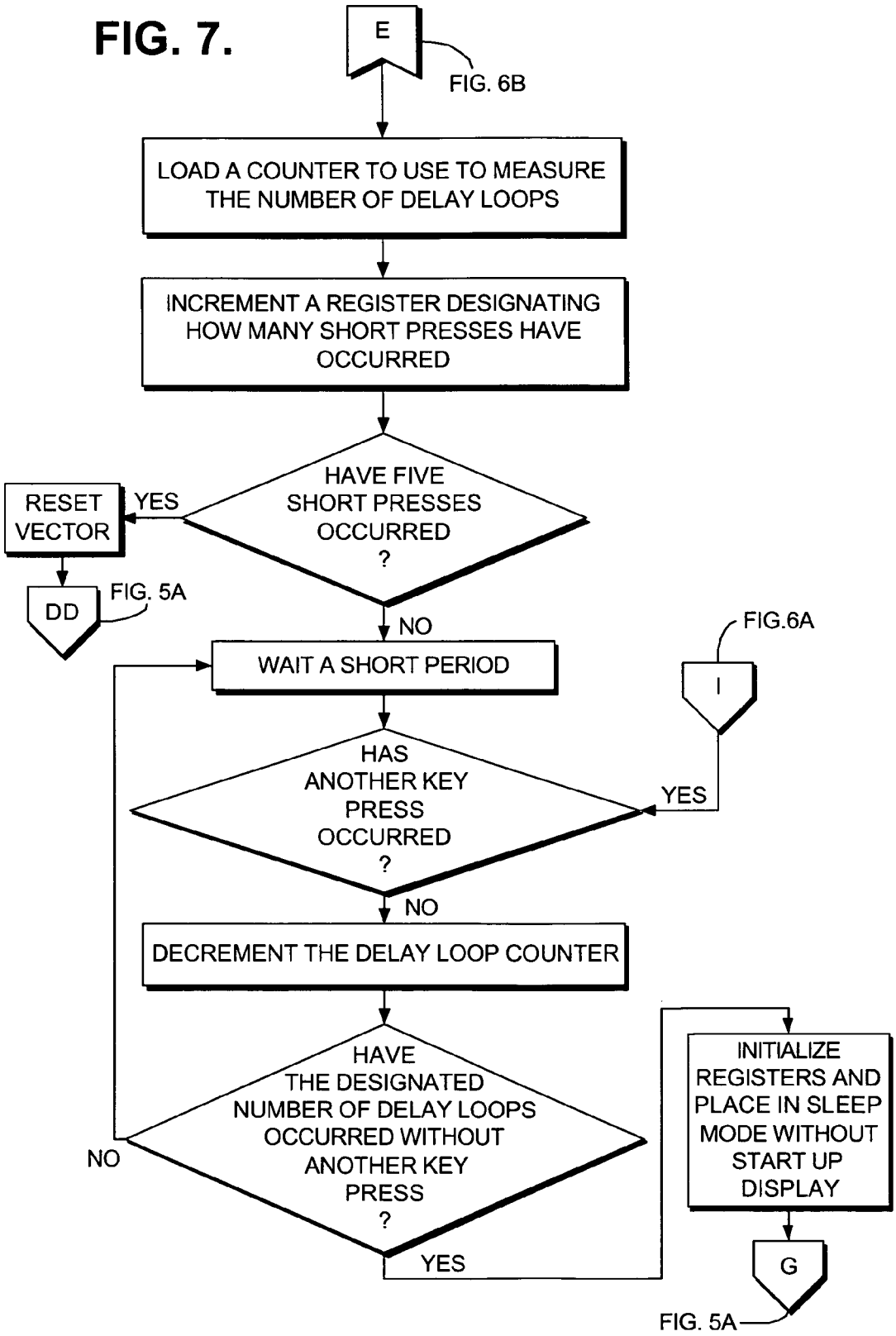
Figure 8:
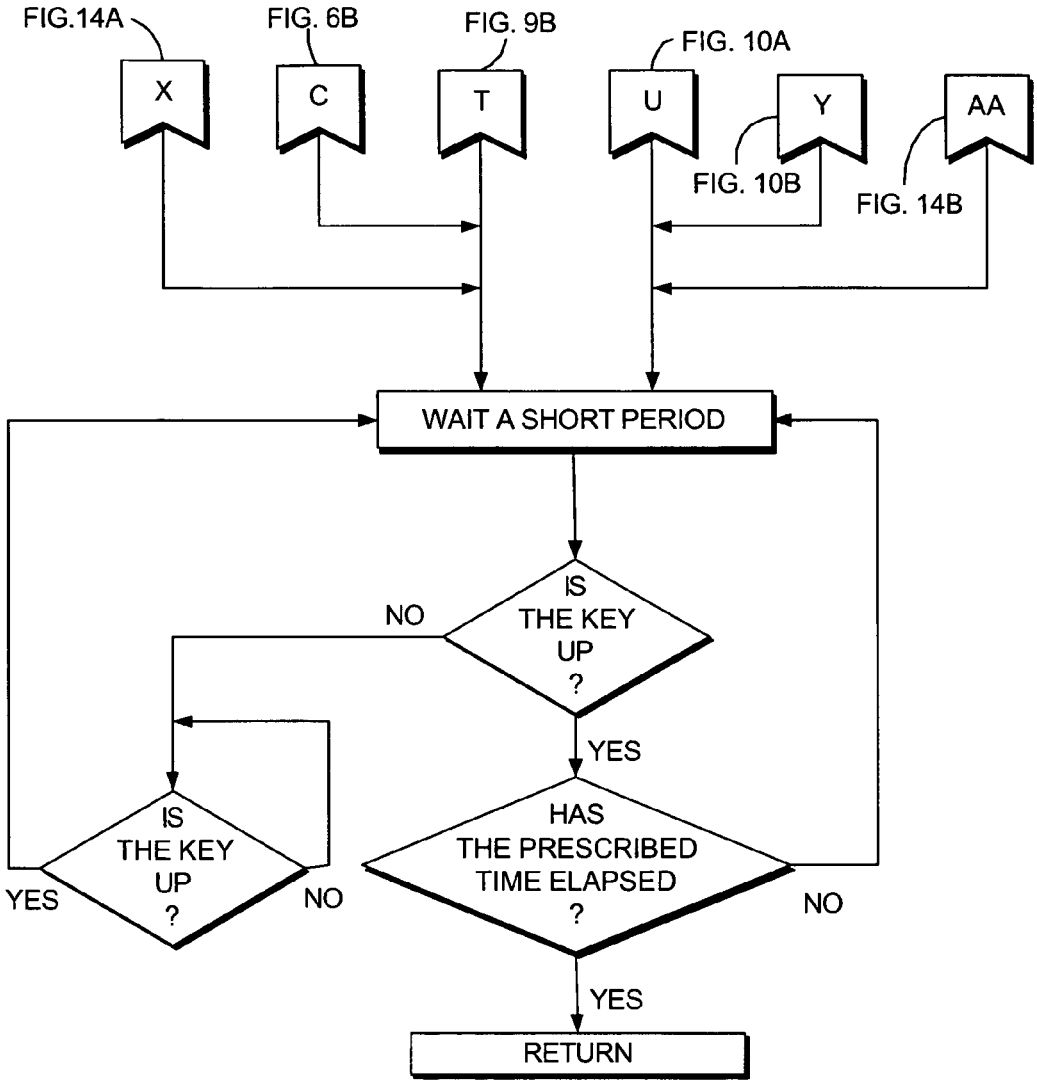
Figure 9A:
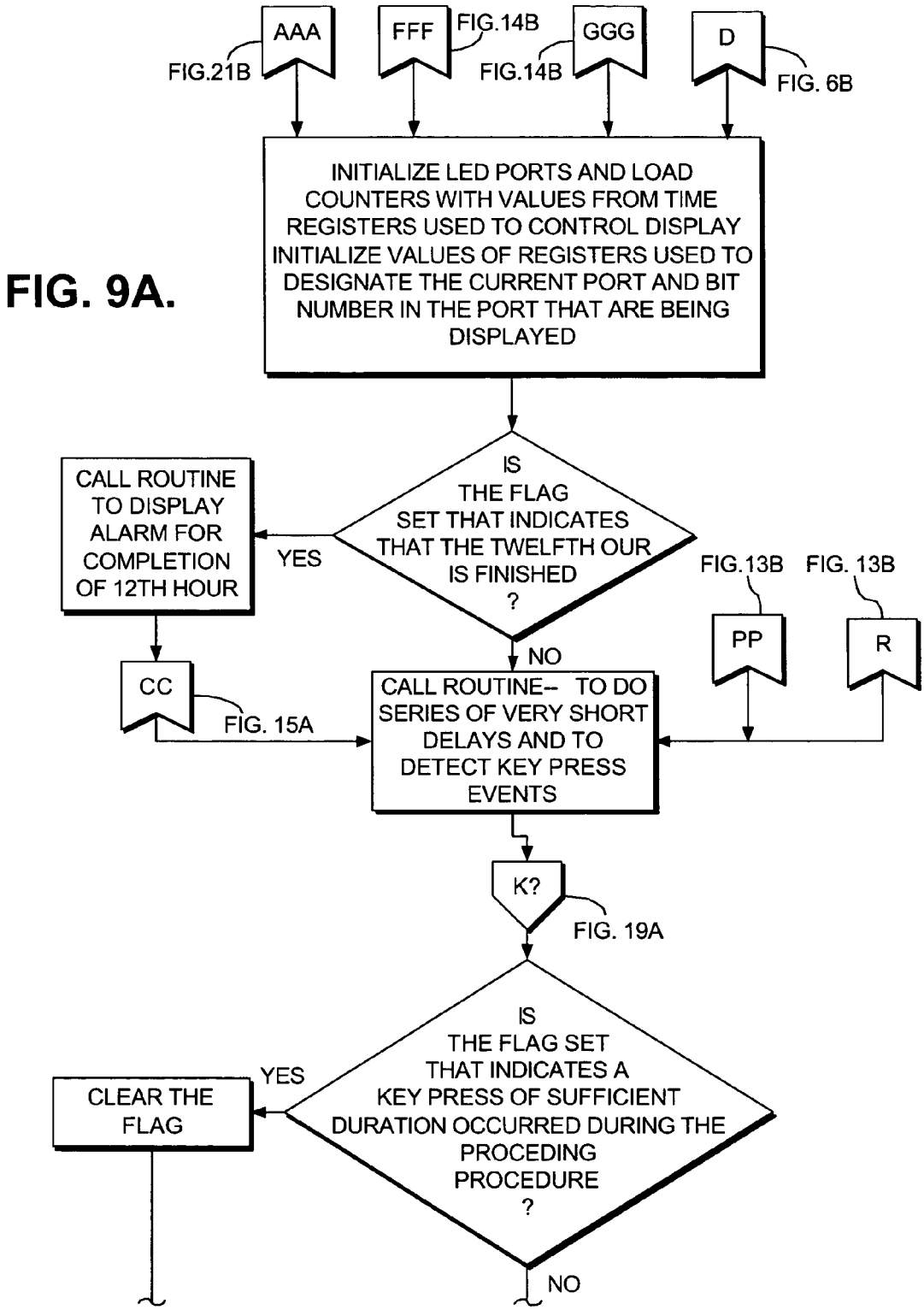
Figure 9B:
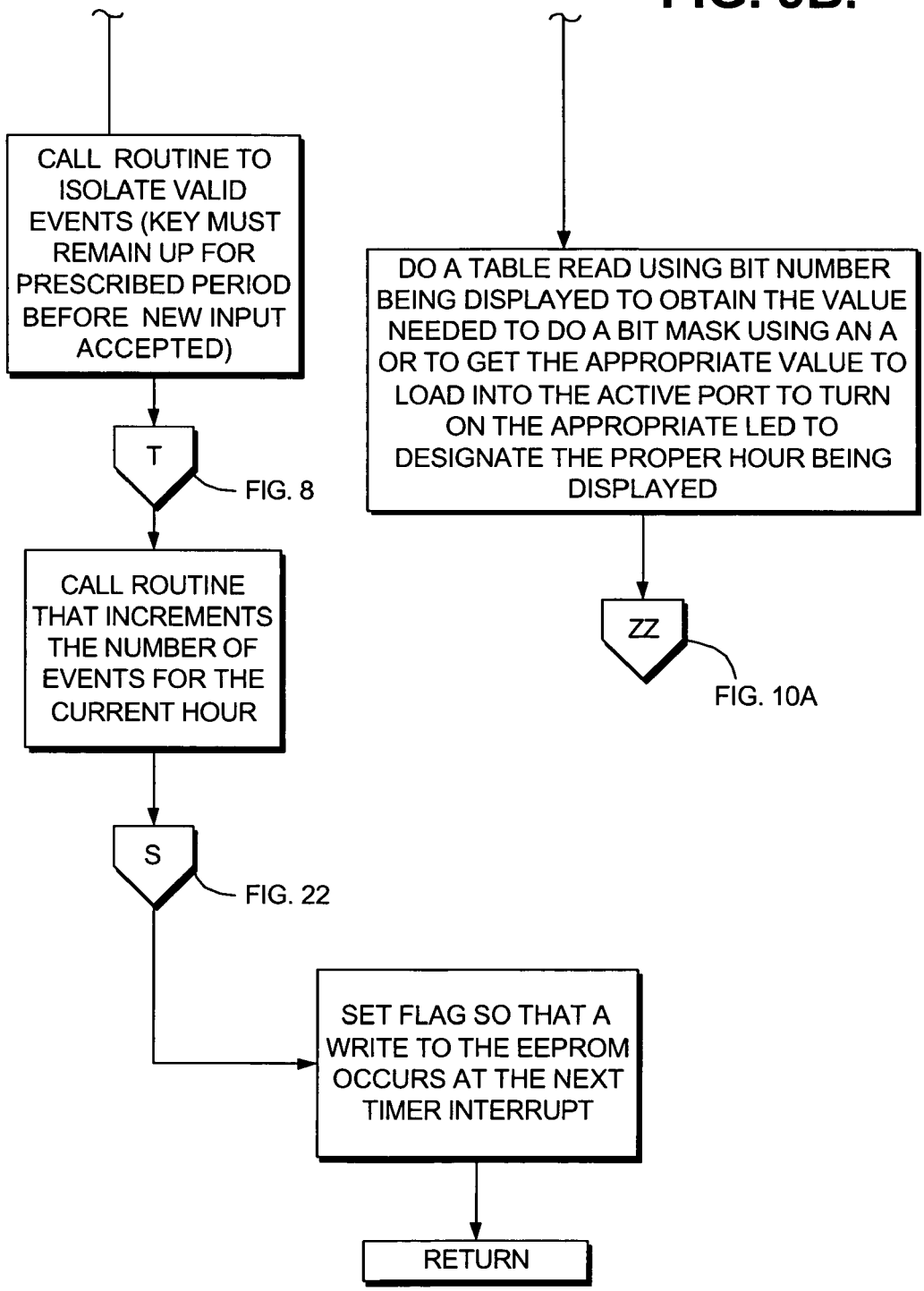
Figure 10A:
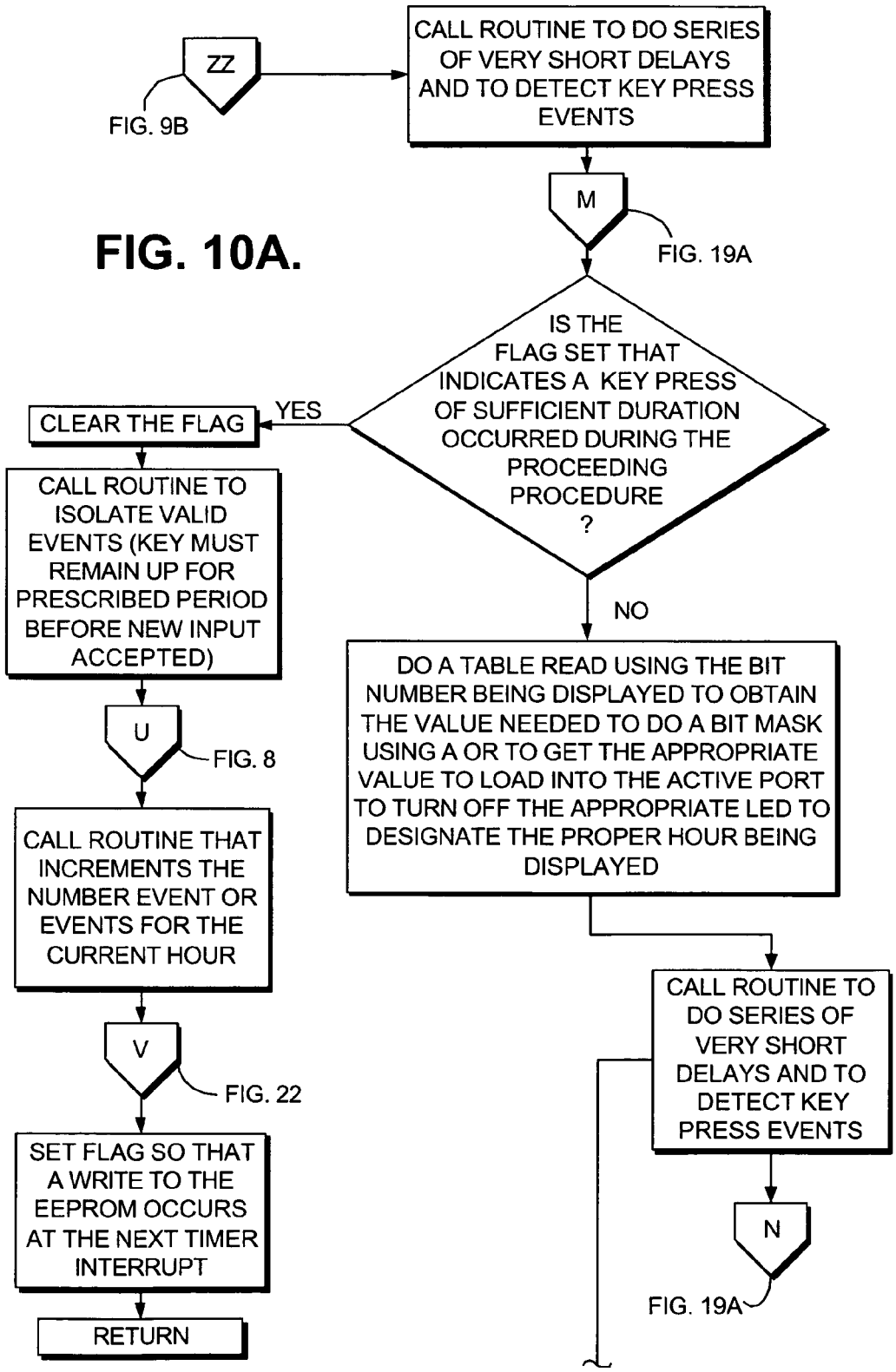
Figure 10B:
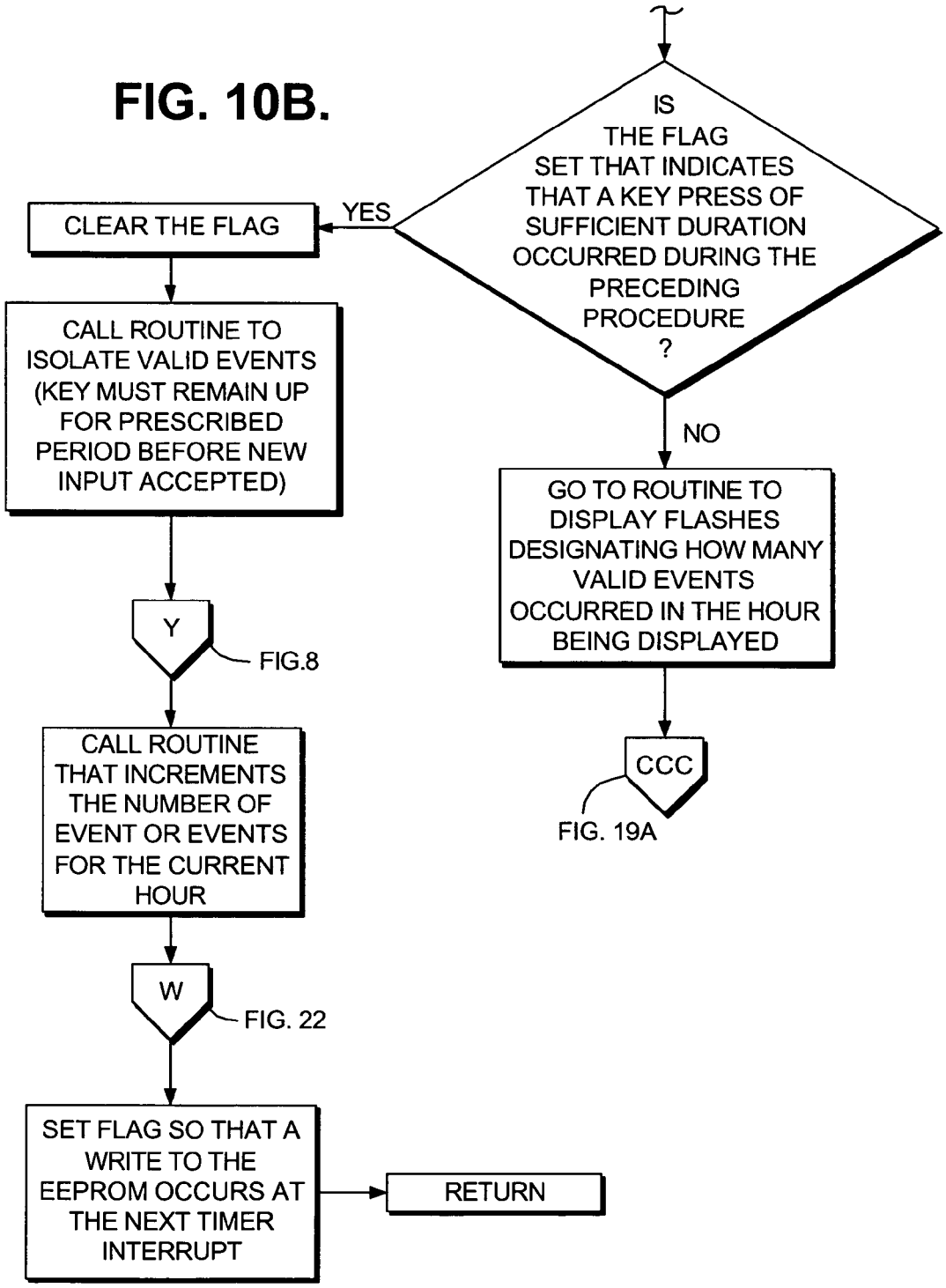
Figure 11A:
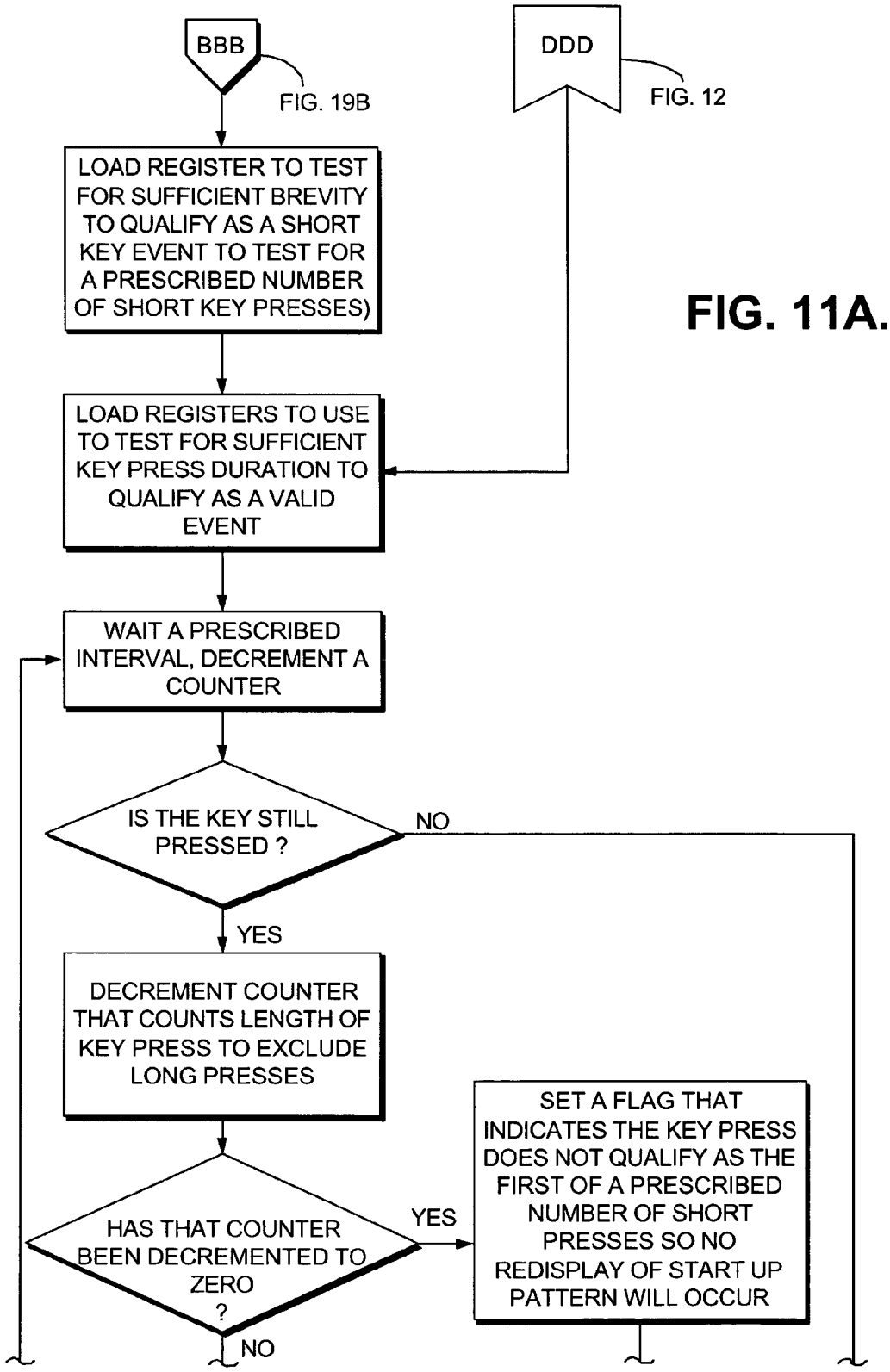
Figure 11B:
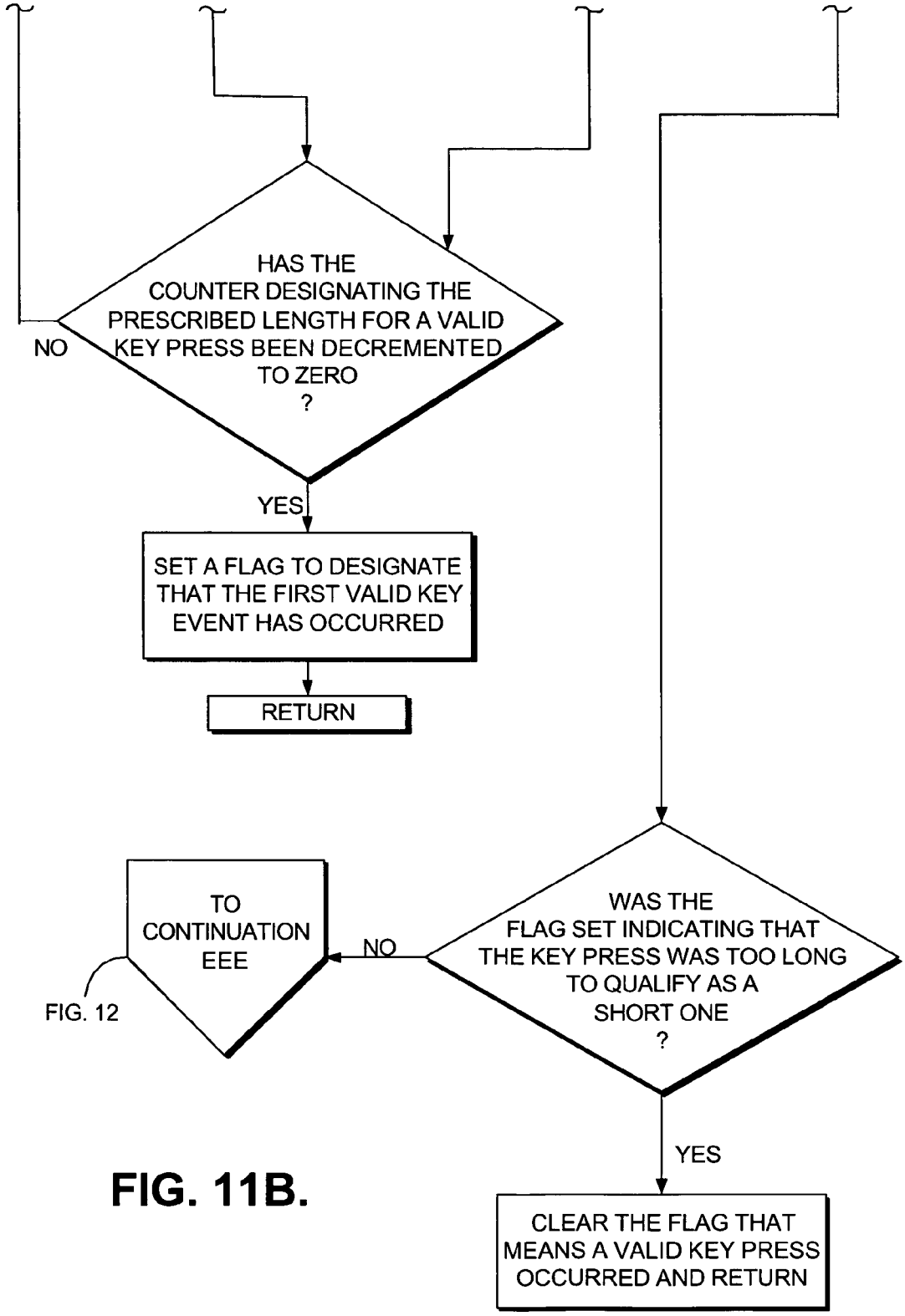
Figure 12:
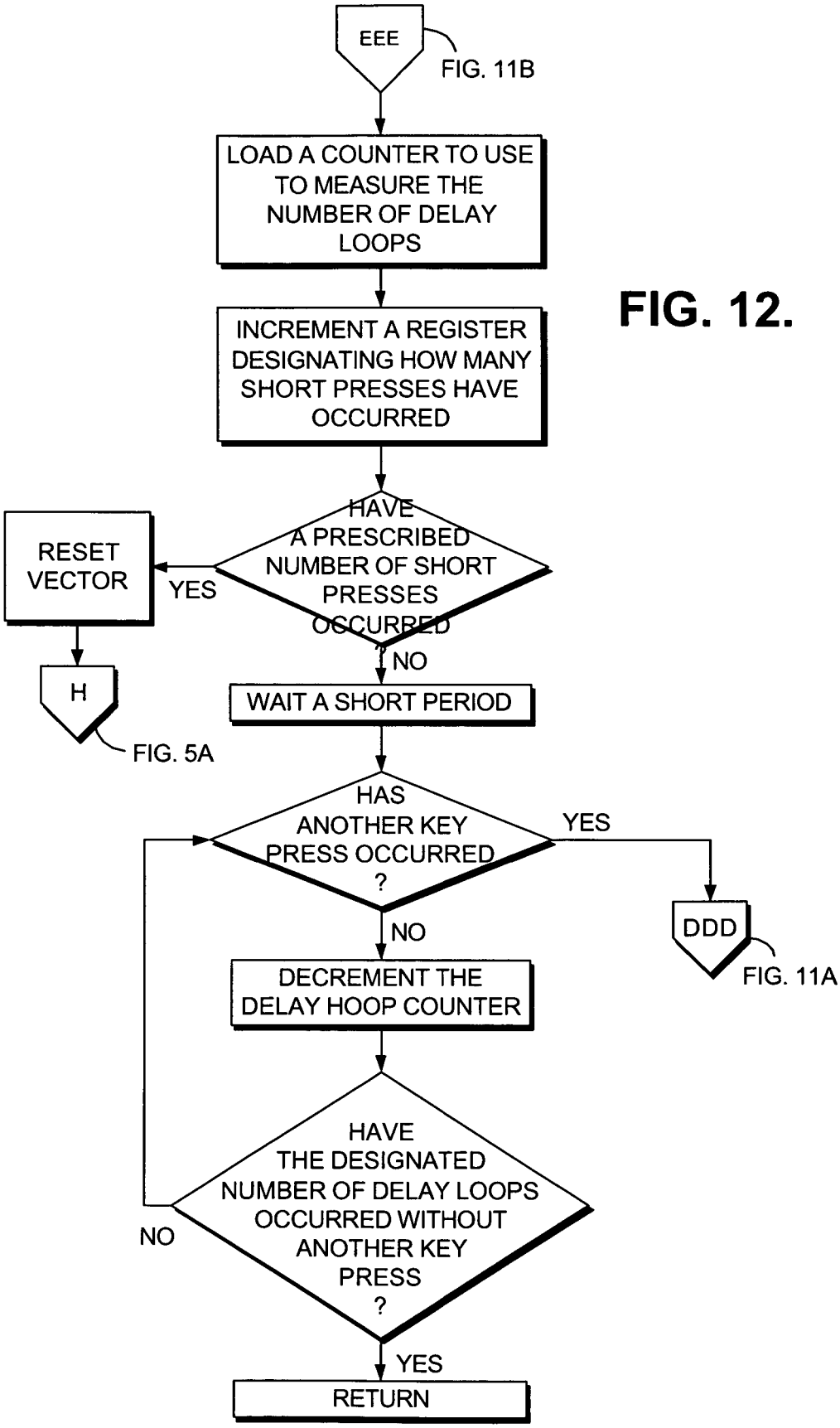
Figure 13B:
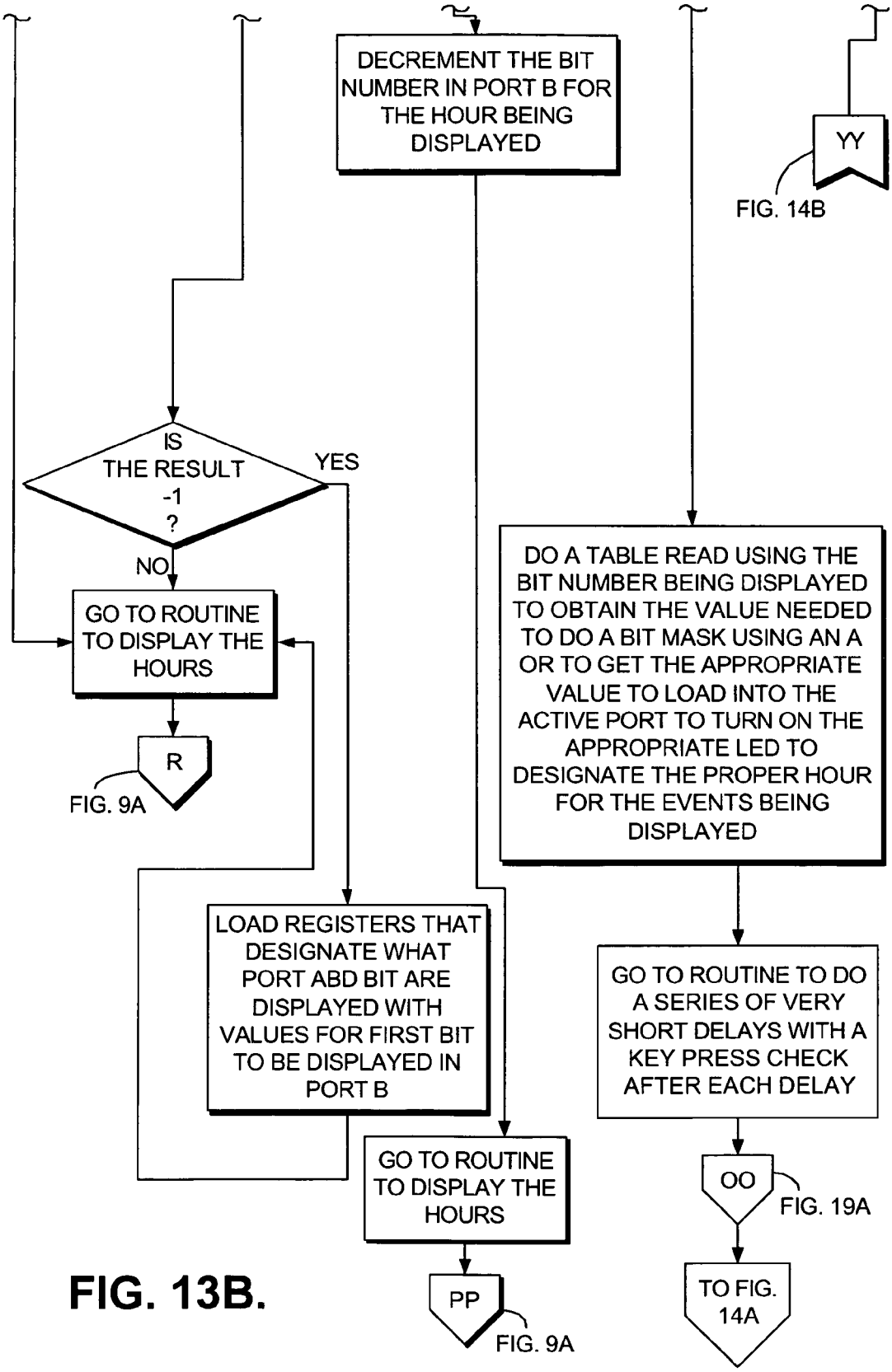
Figure 14A:
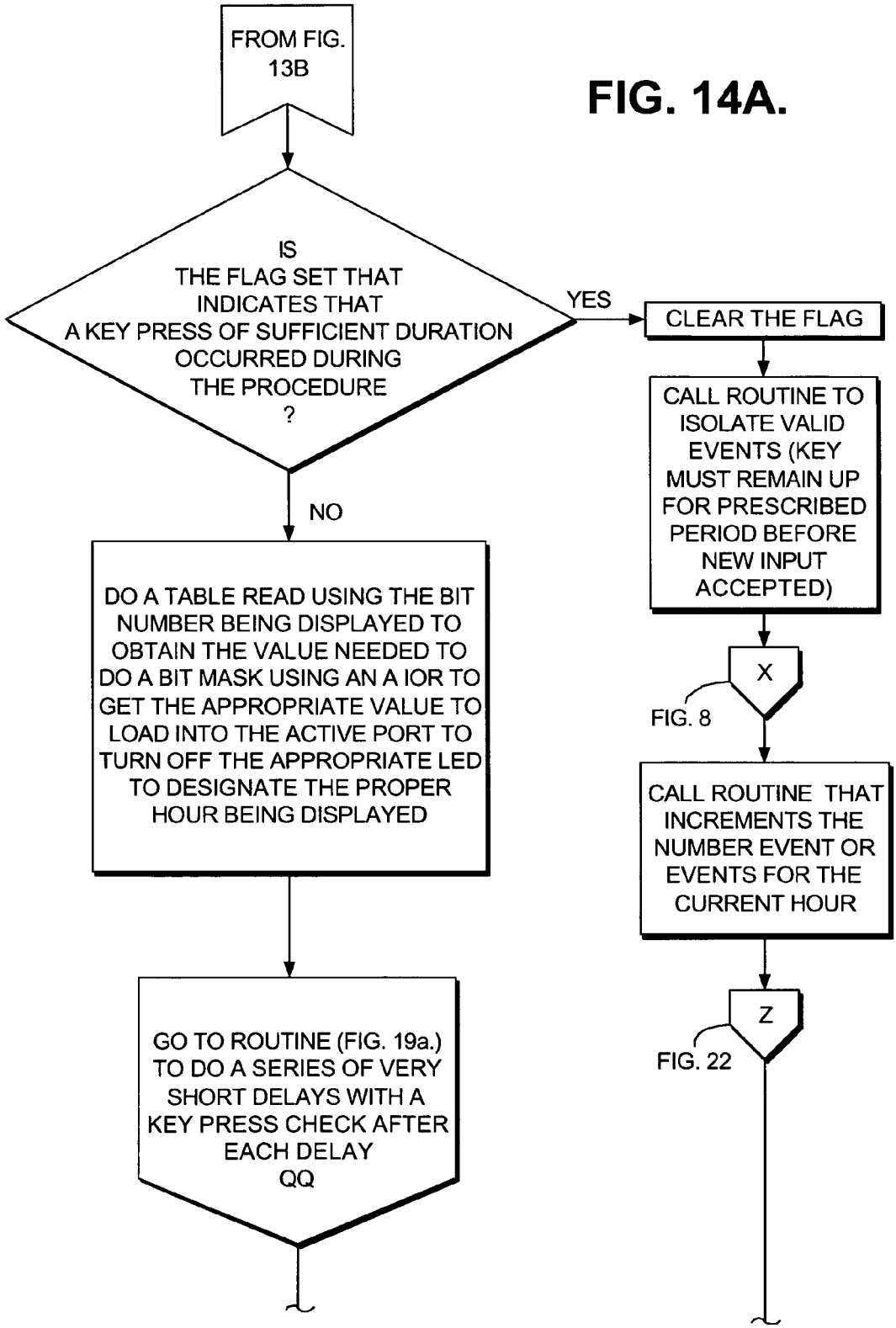
Figure 14B:
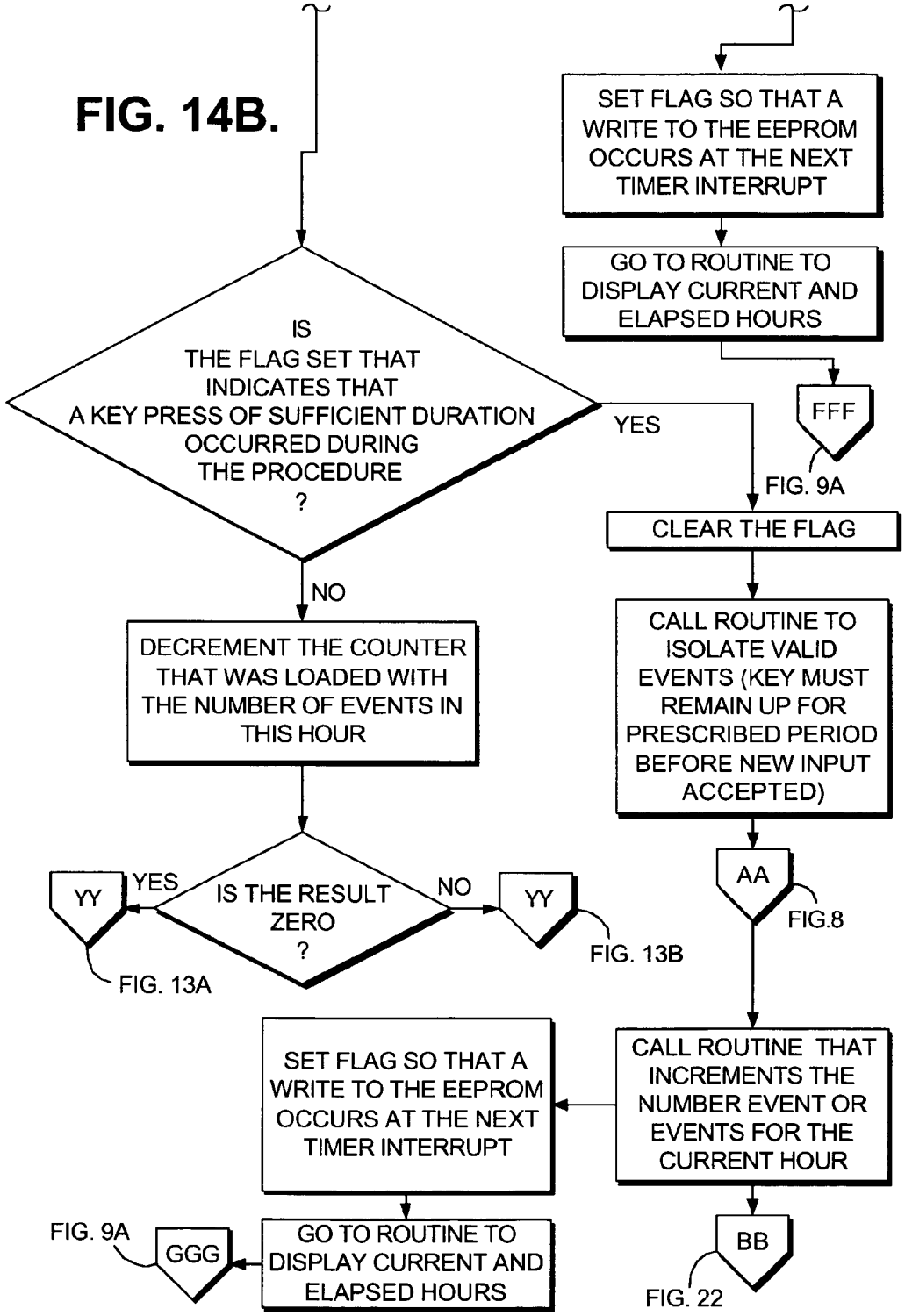
Figure 15A:
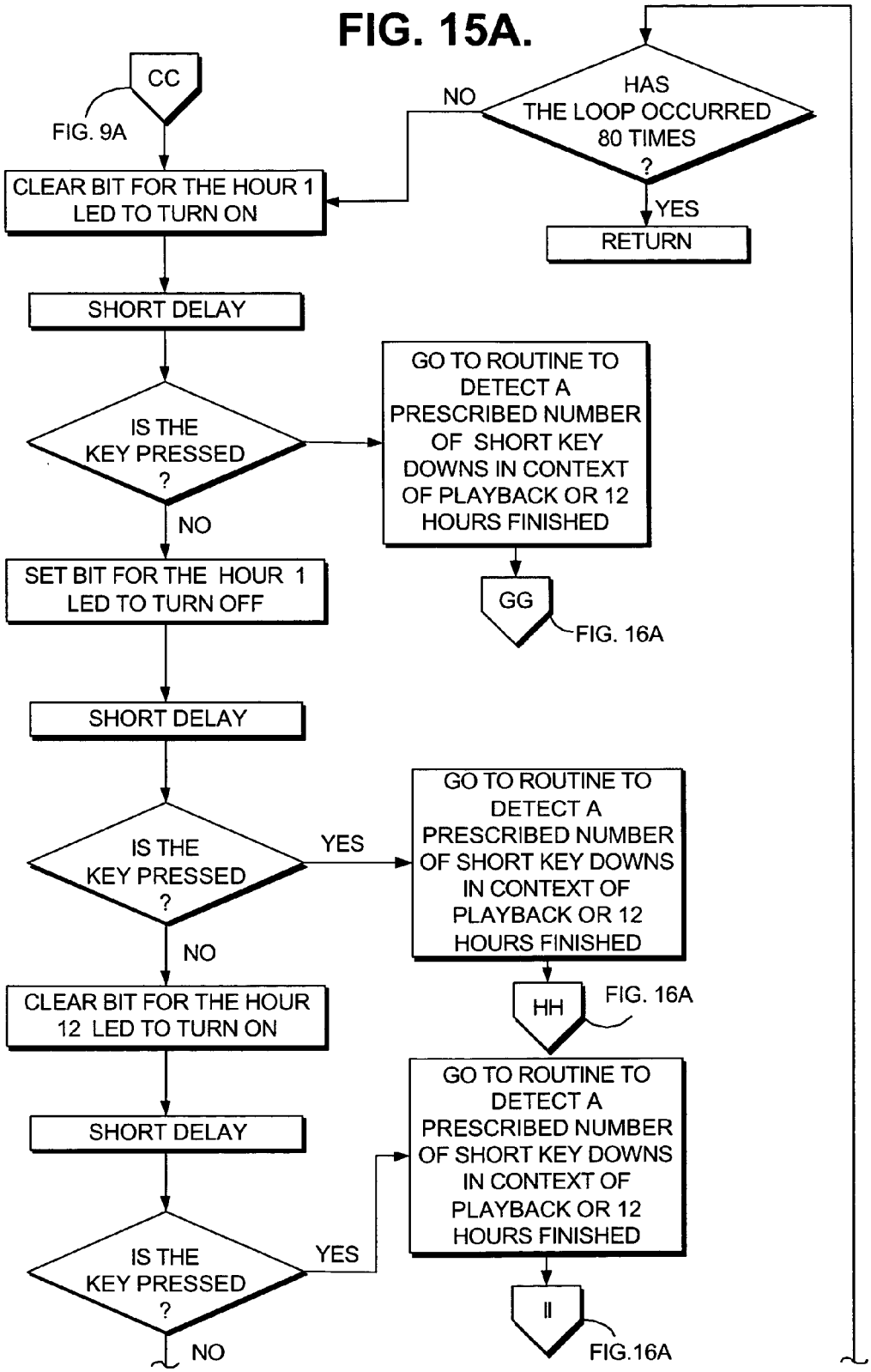
Figure 15B:
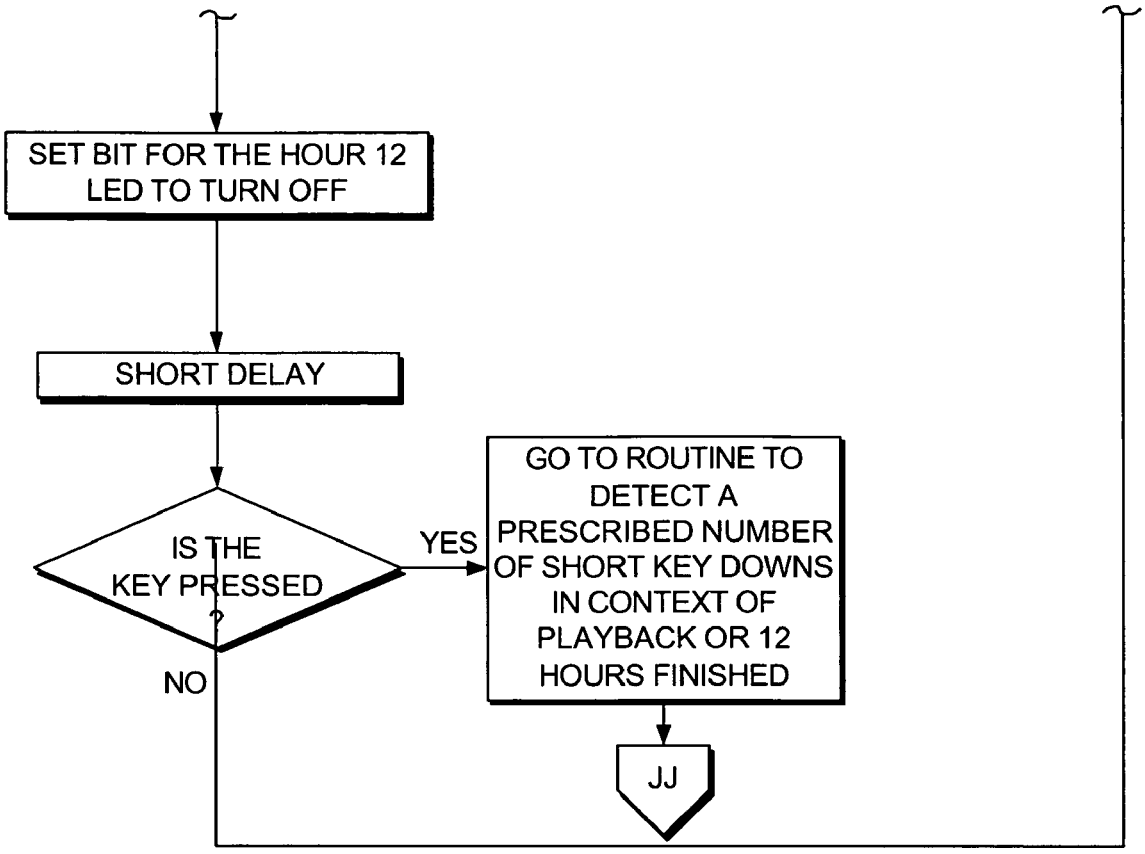
Figure 16A:
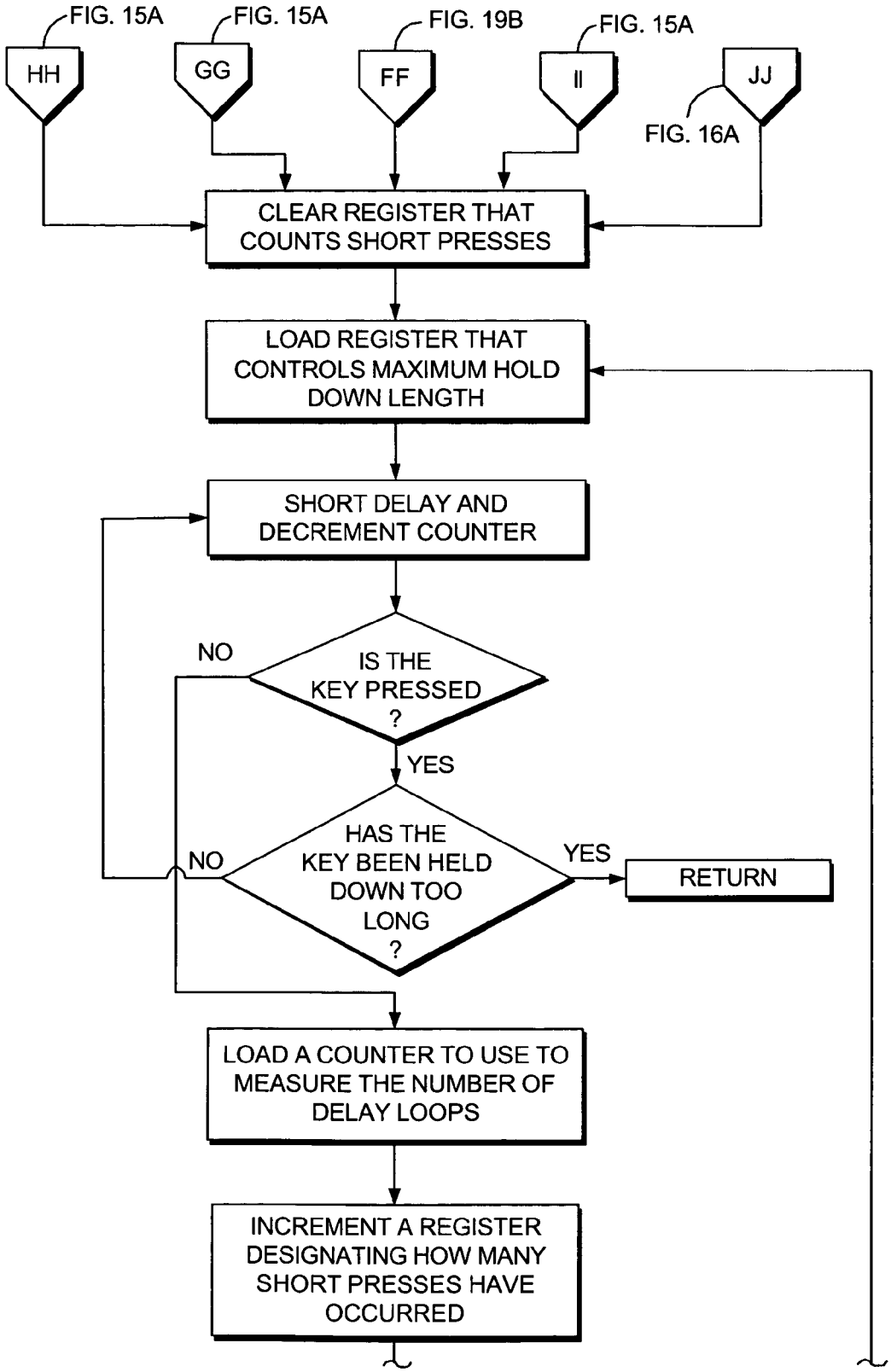
Figures 5A, 16B:
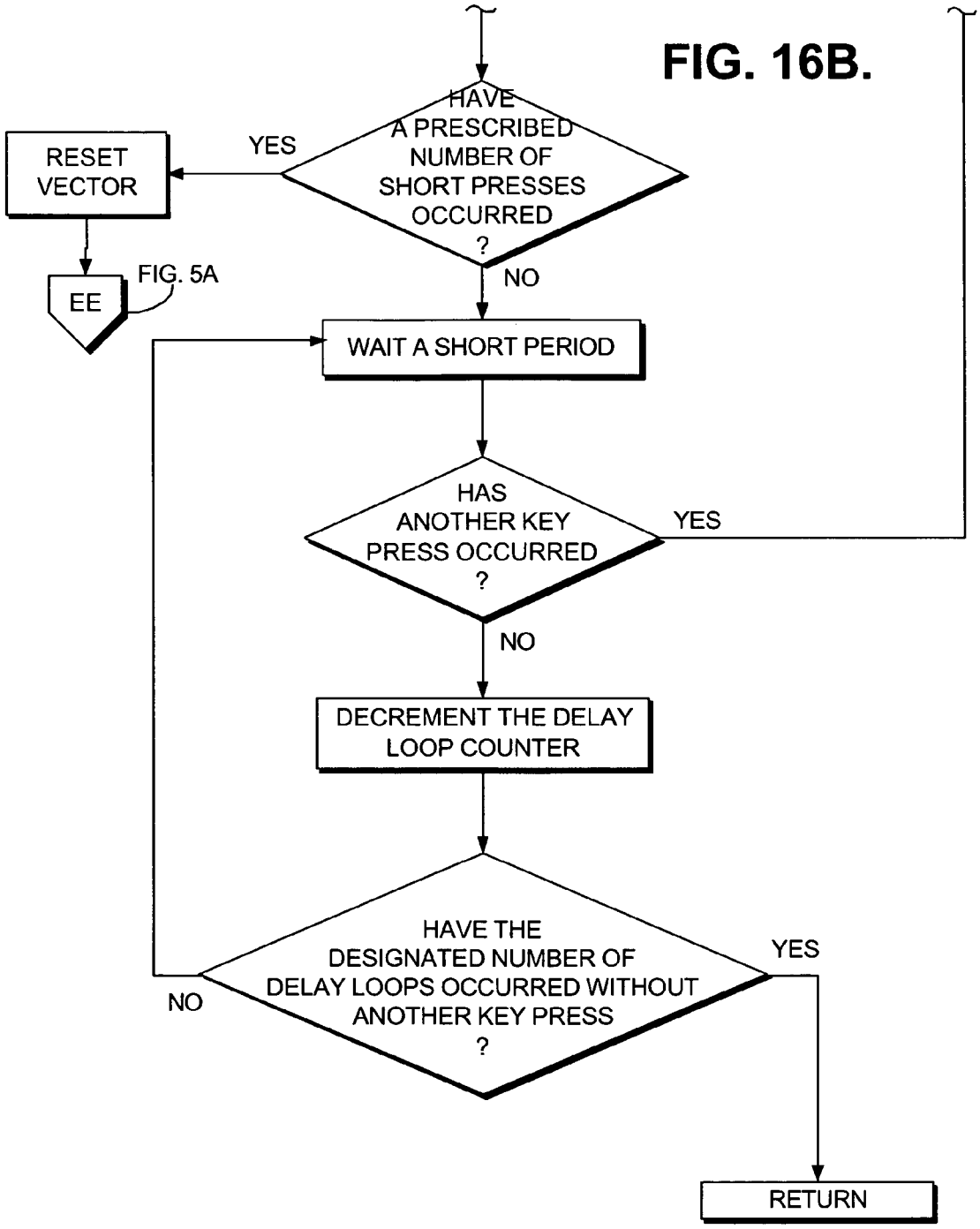
Figure 17A:
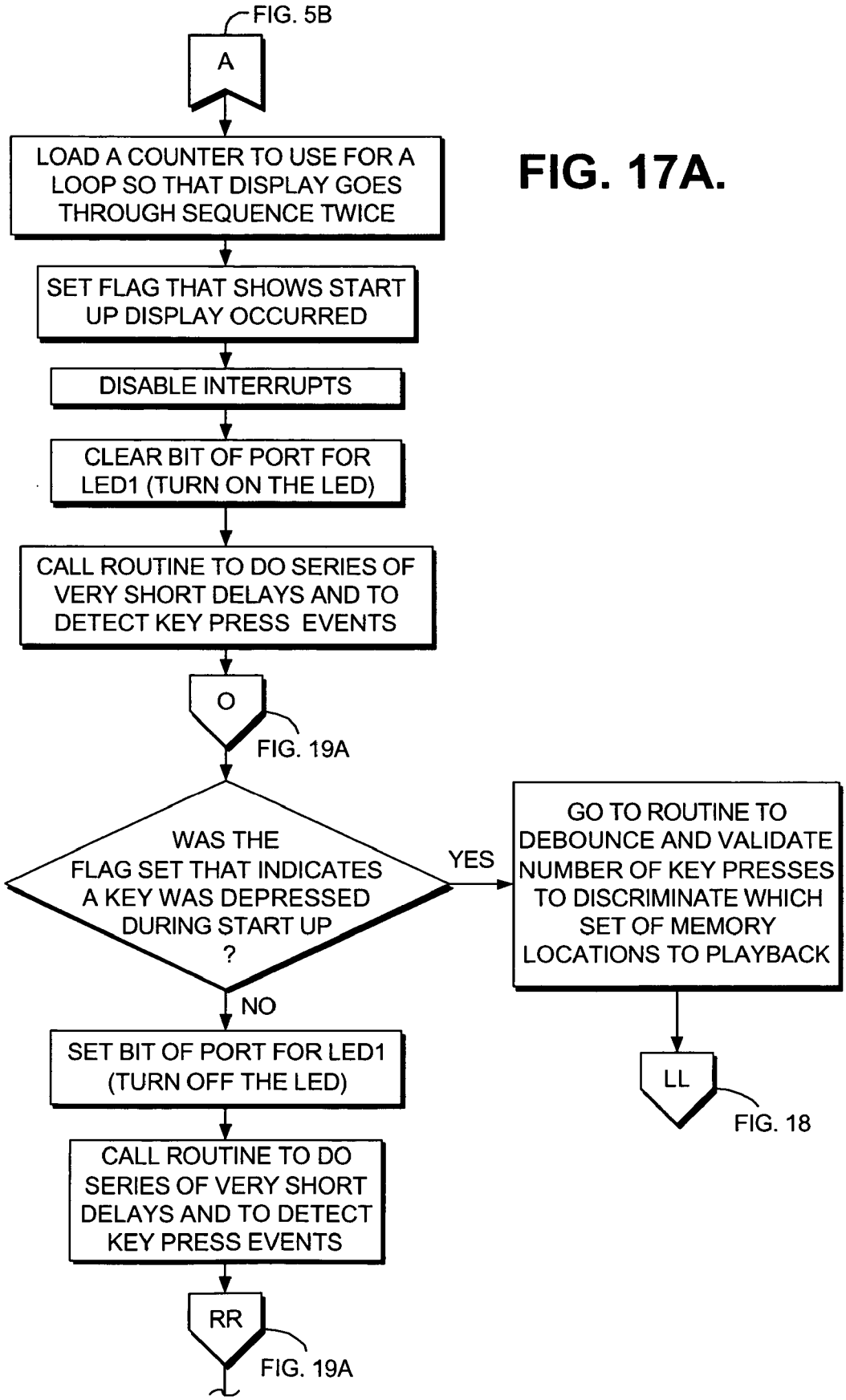
Figure 17B:
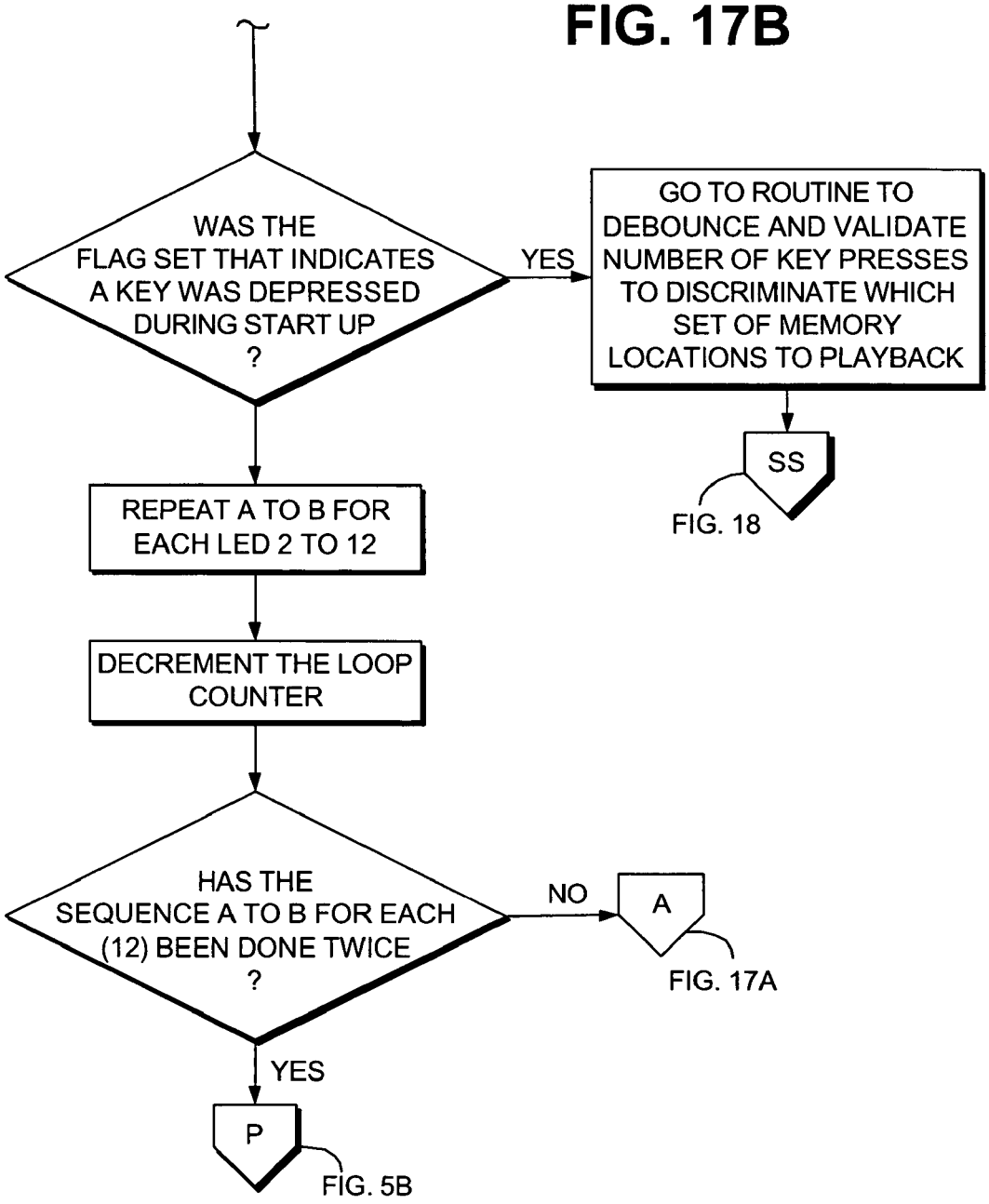
Figure 18:
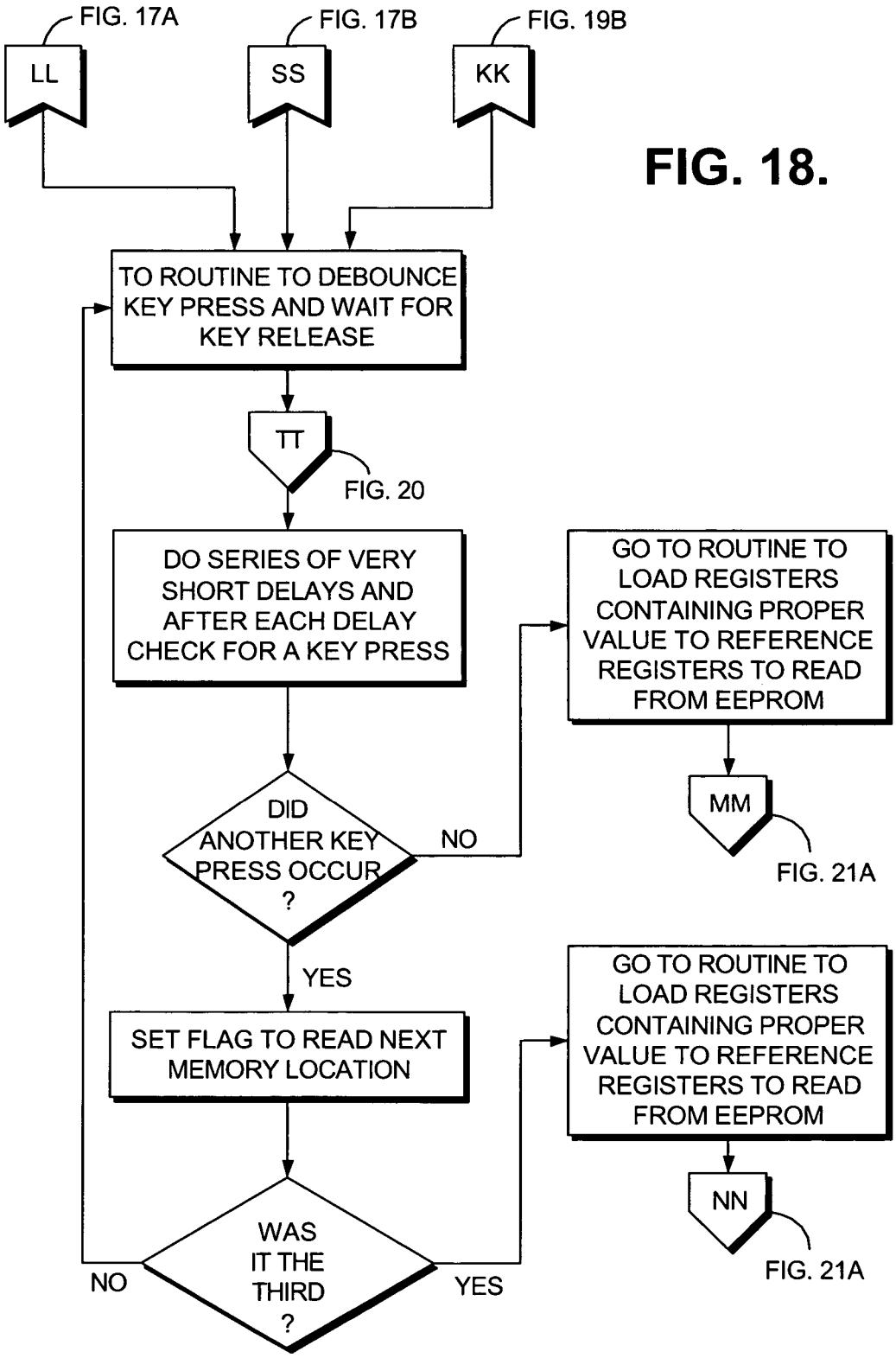
Figure 19A:
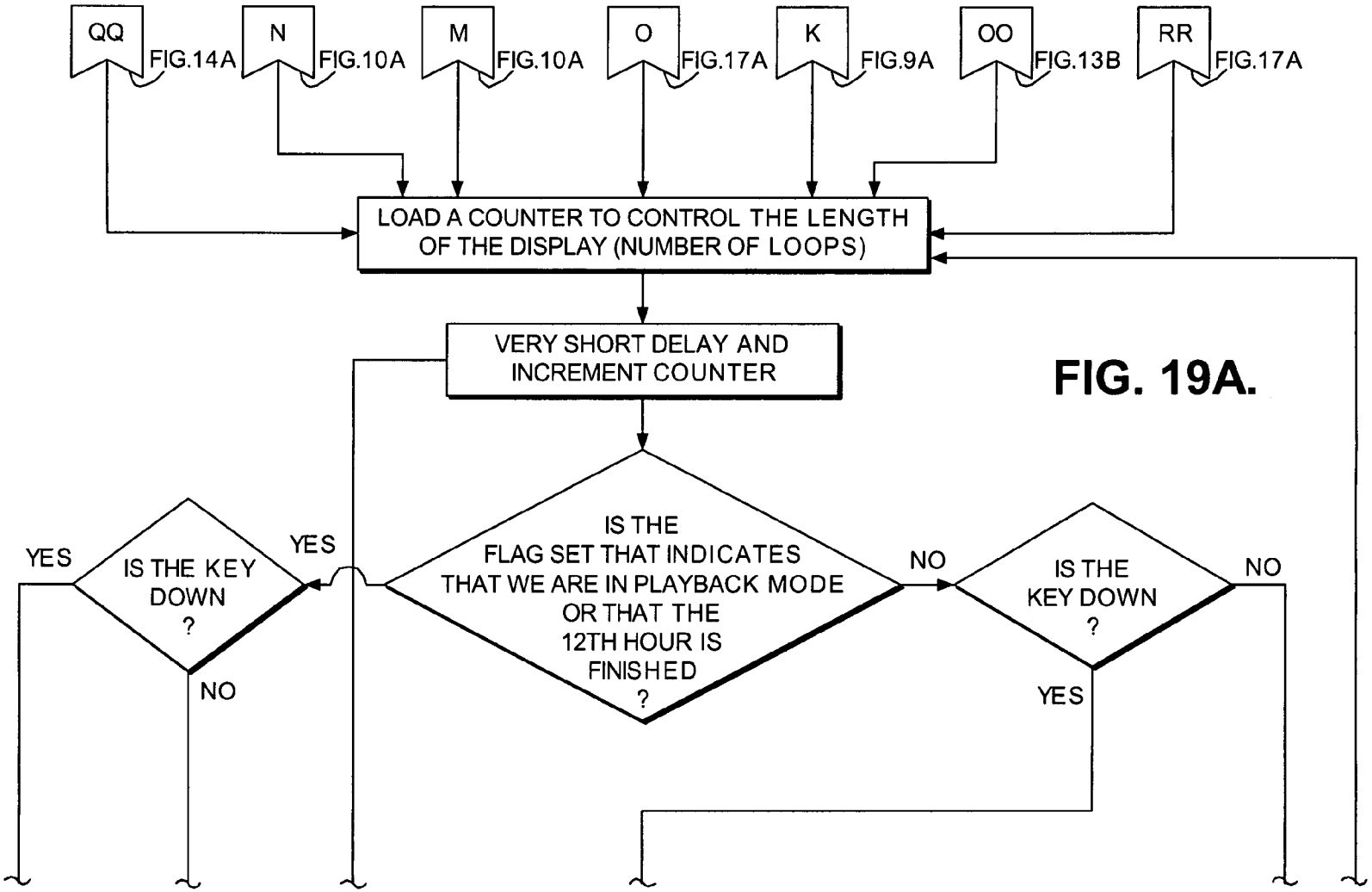
Figure 19B:
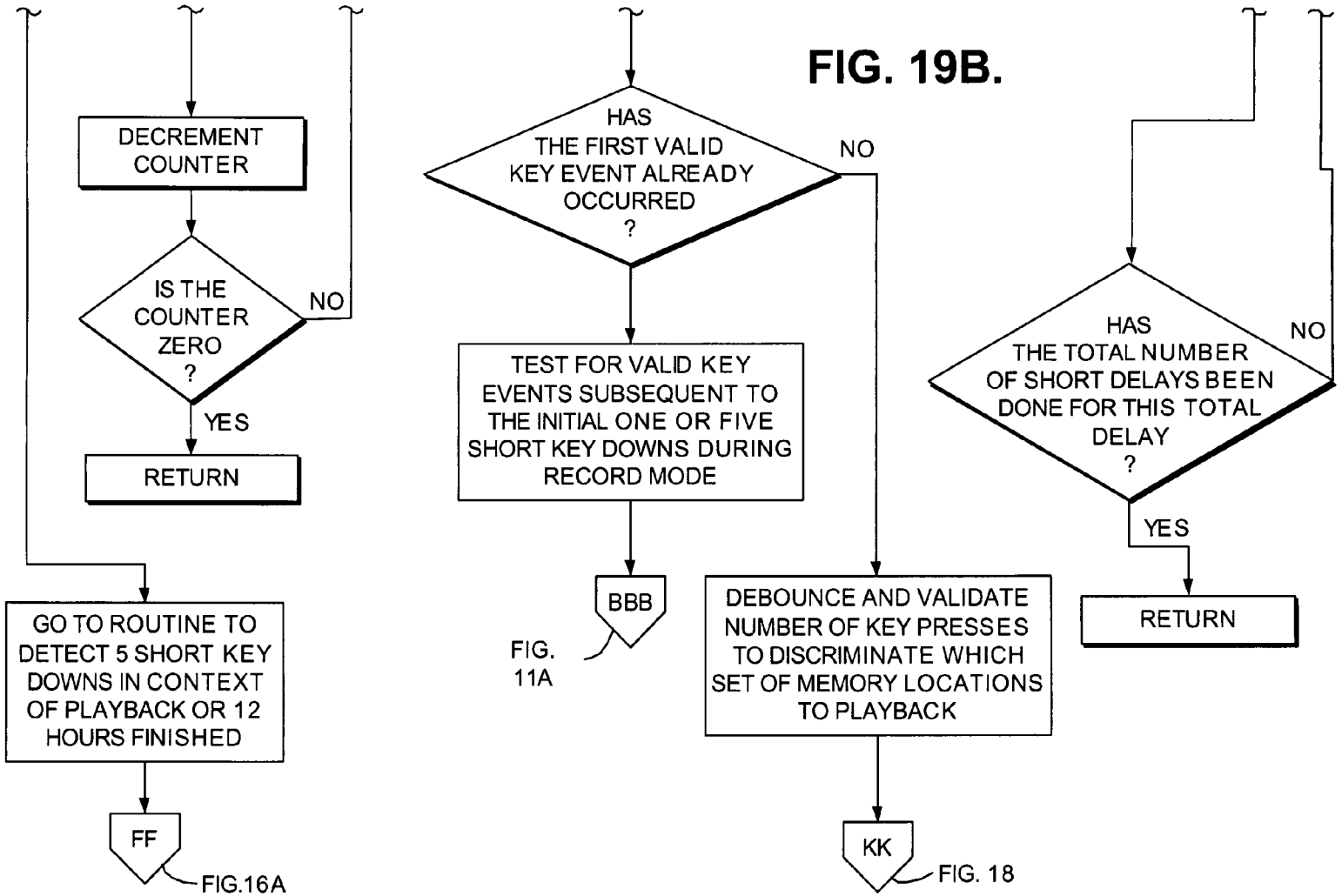
Figure 20:
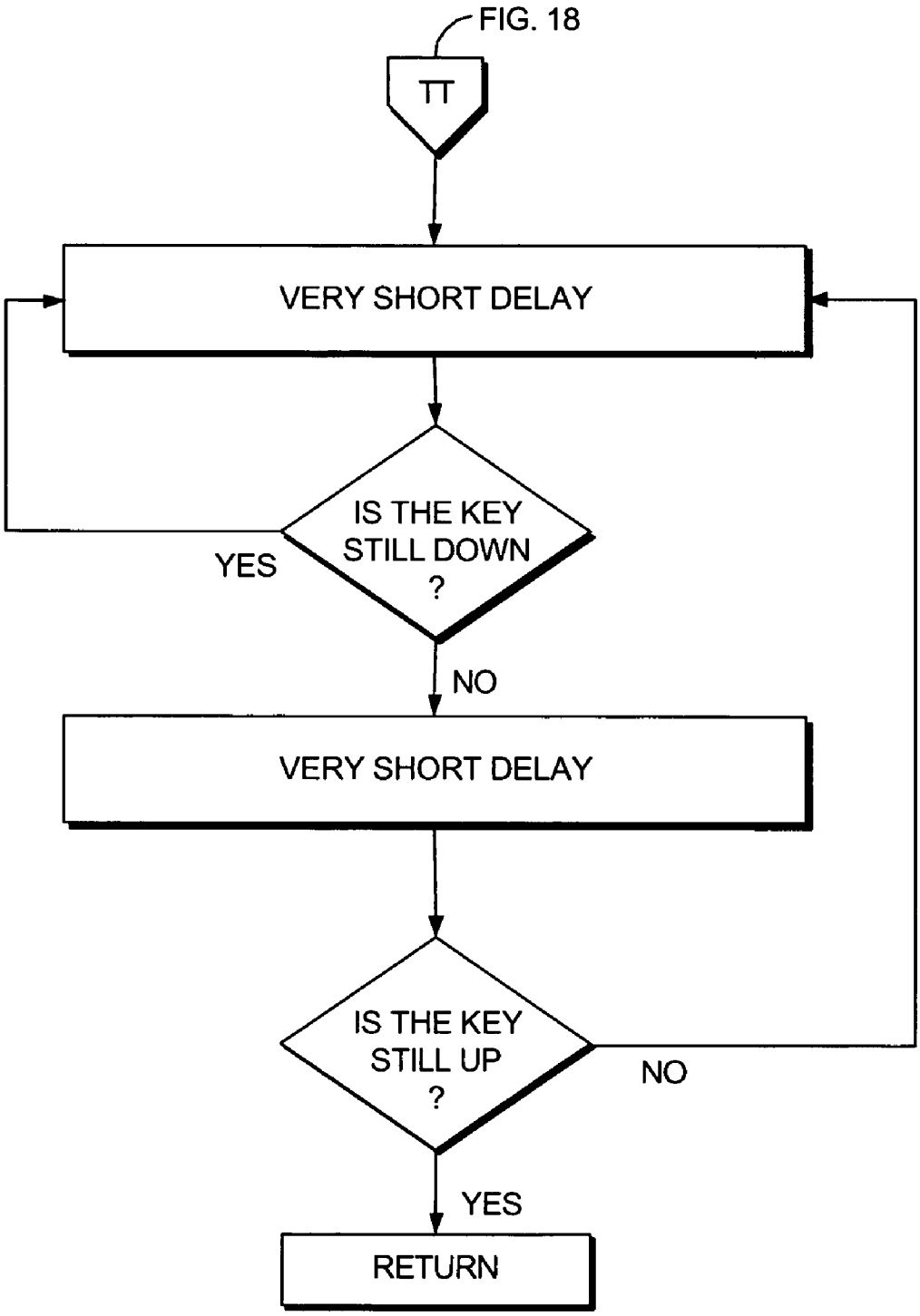
Figure 21A:
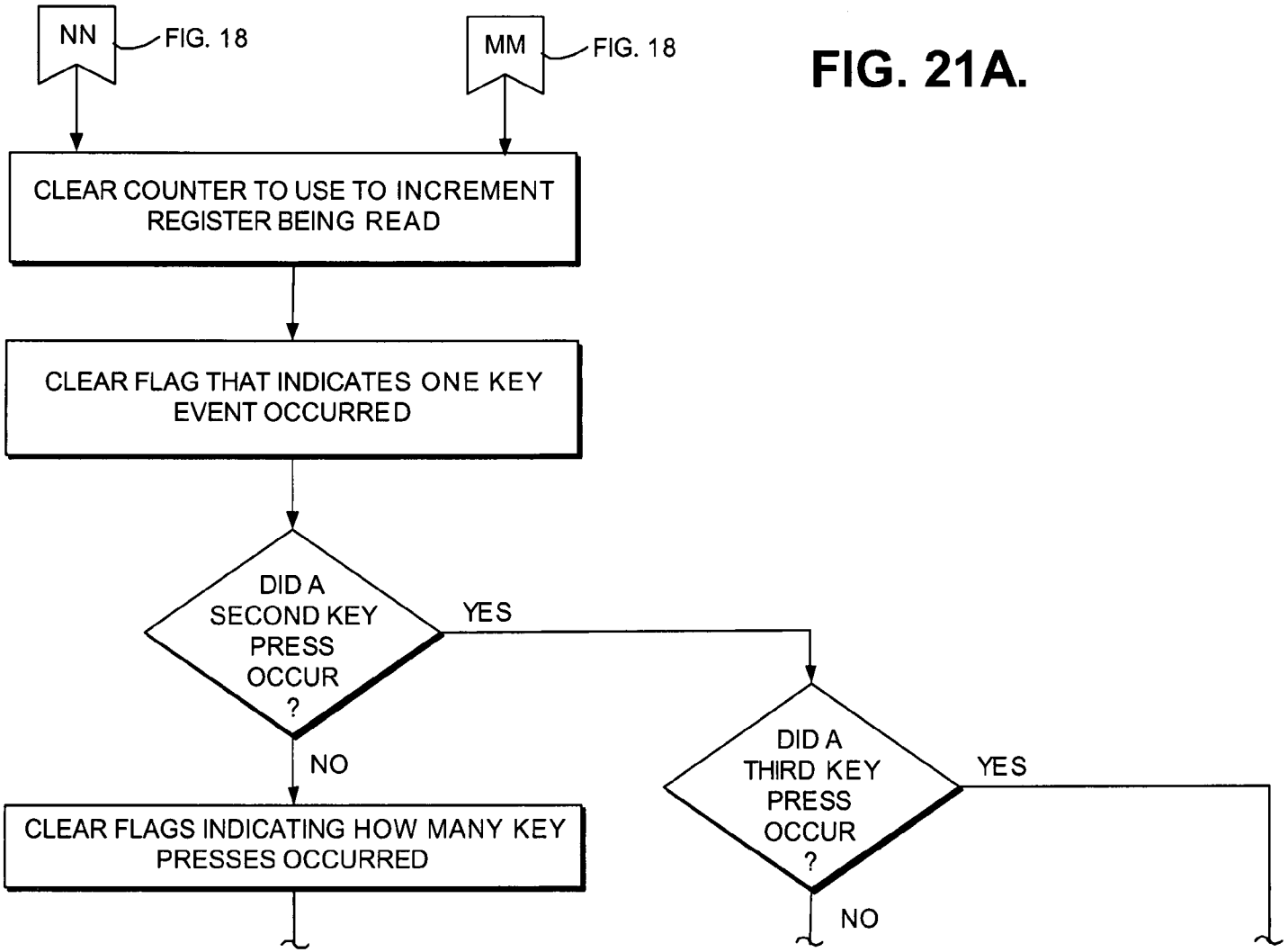
Figure 21B:
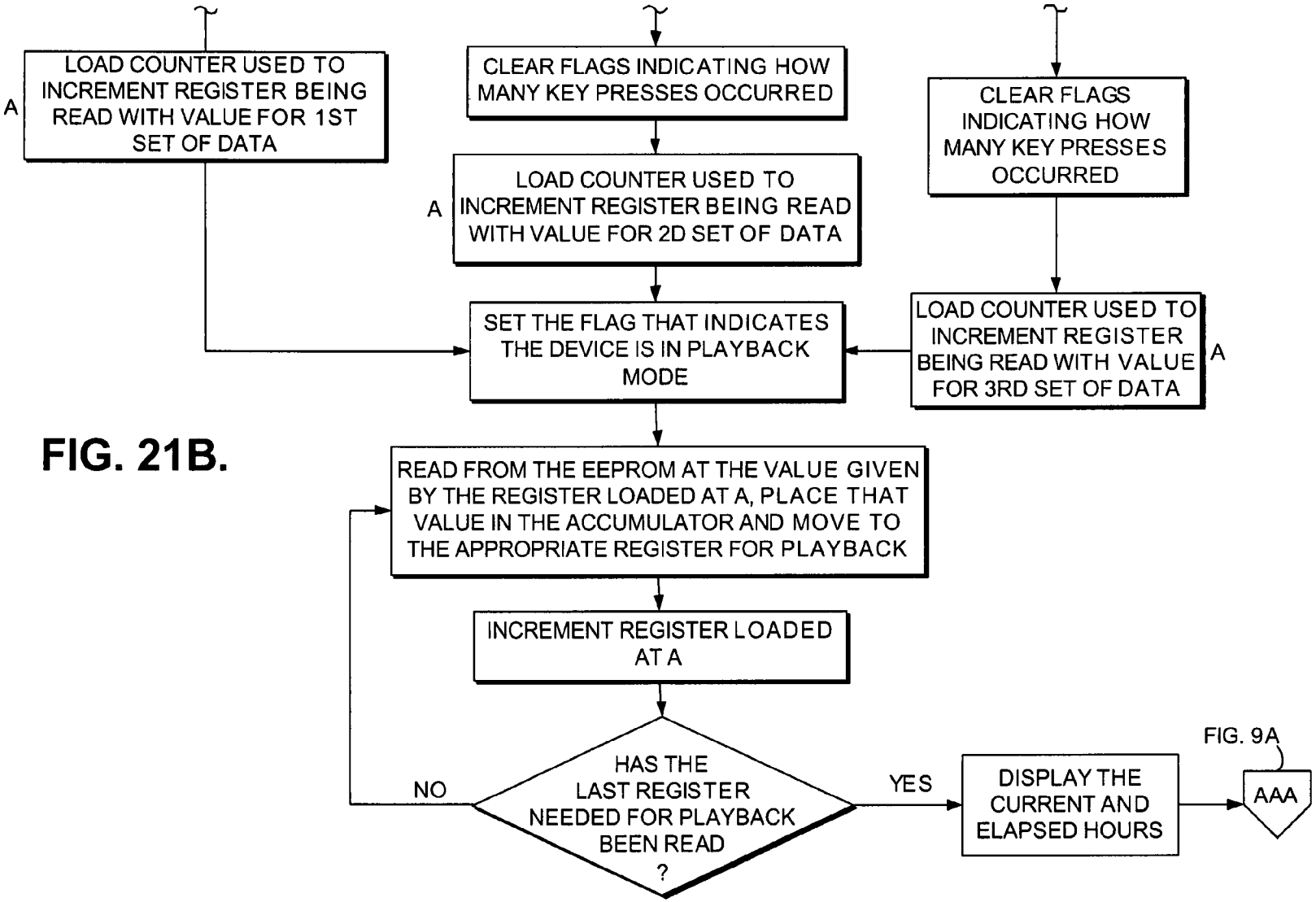
Figure 22:
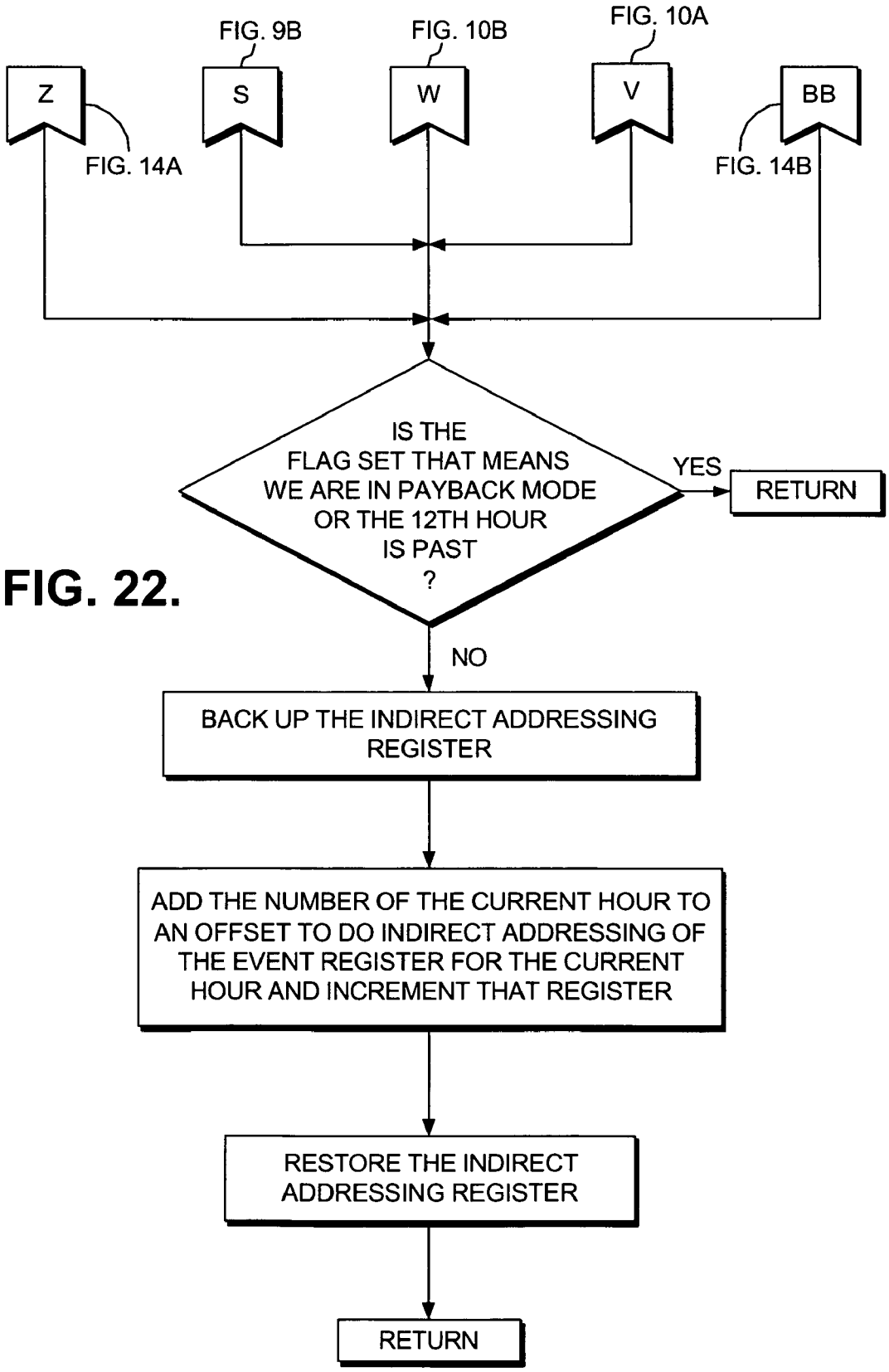
Figure 23:
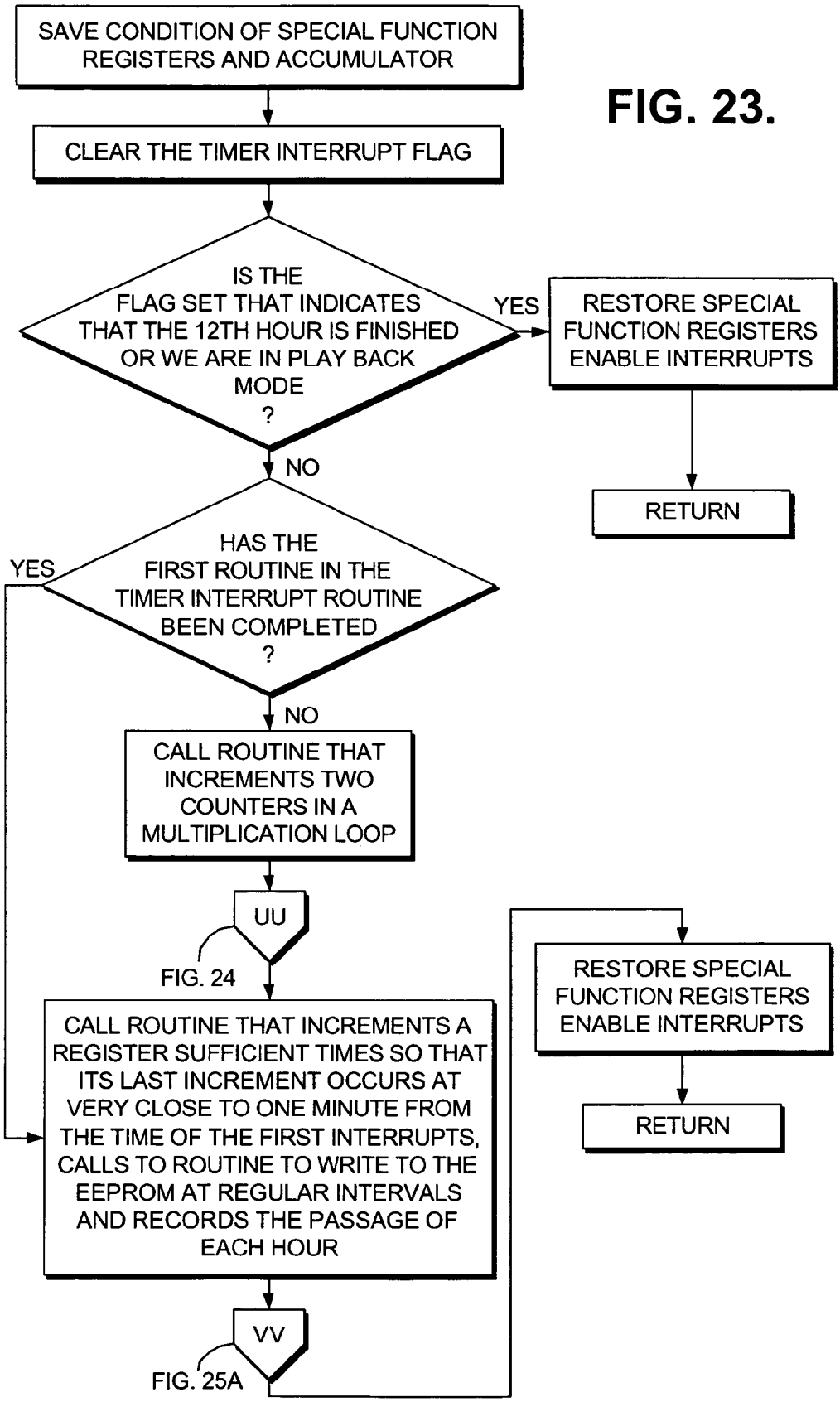
Figure 24:
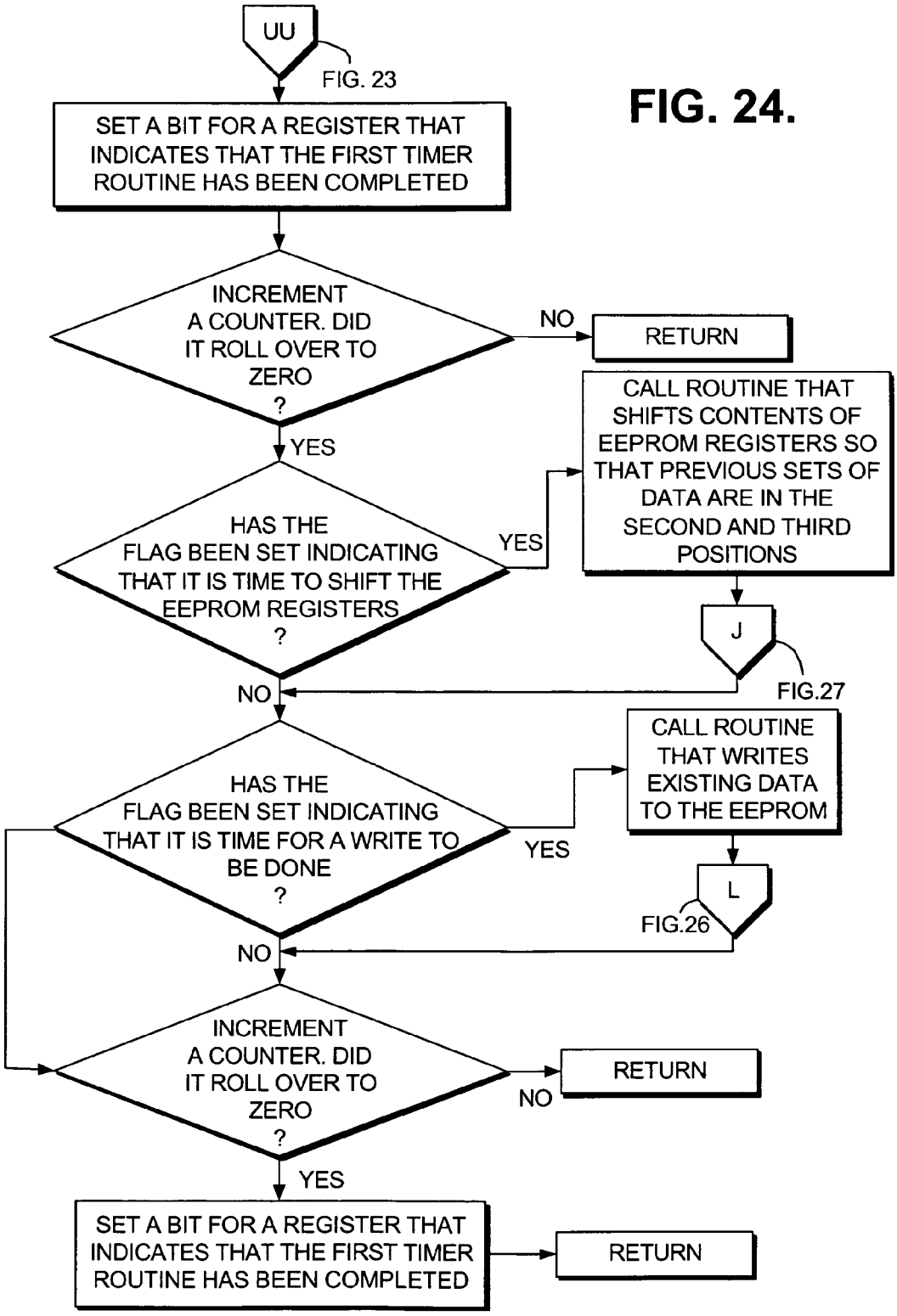
Figure 25A:
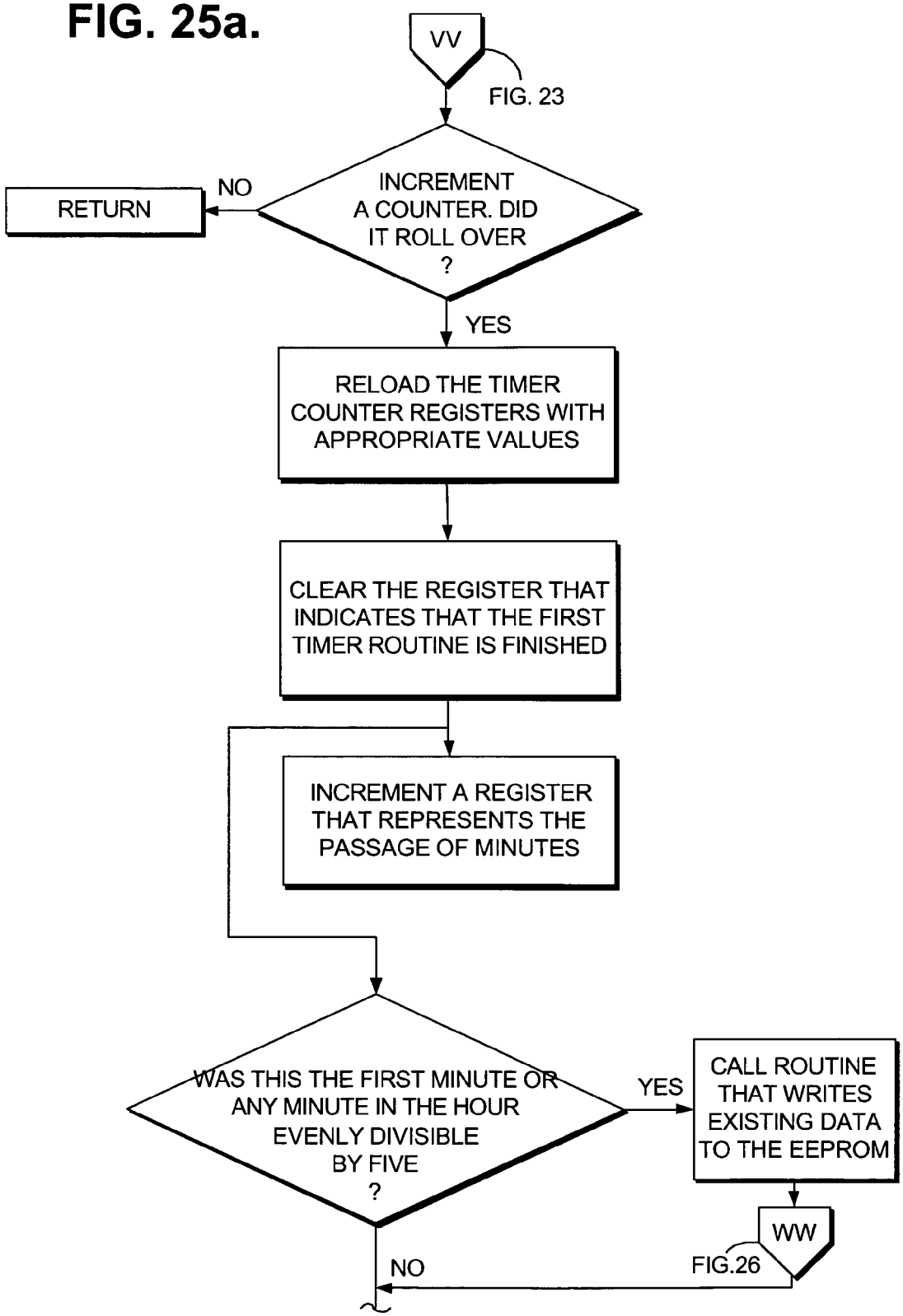
Figure 25B:
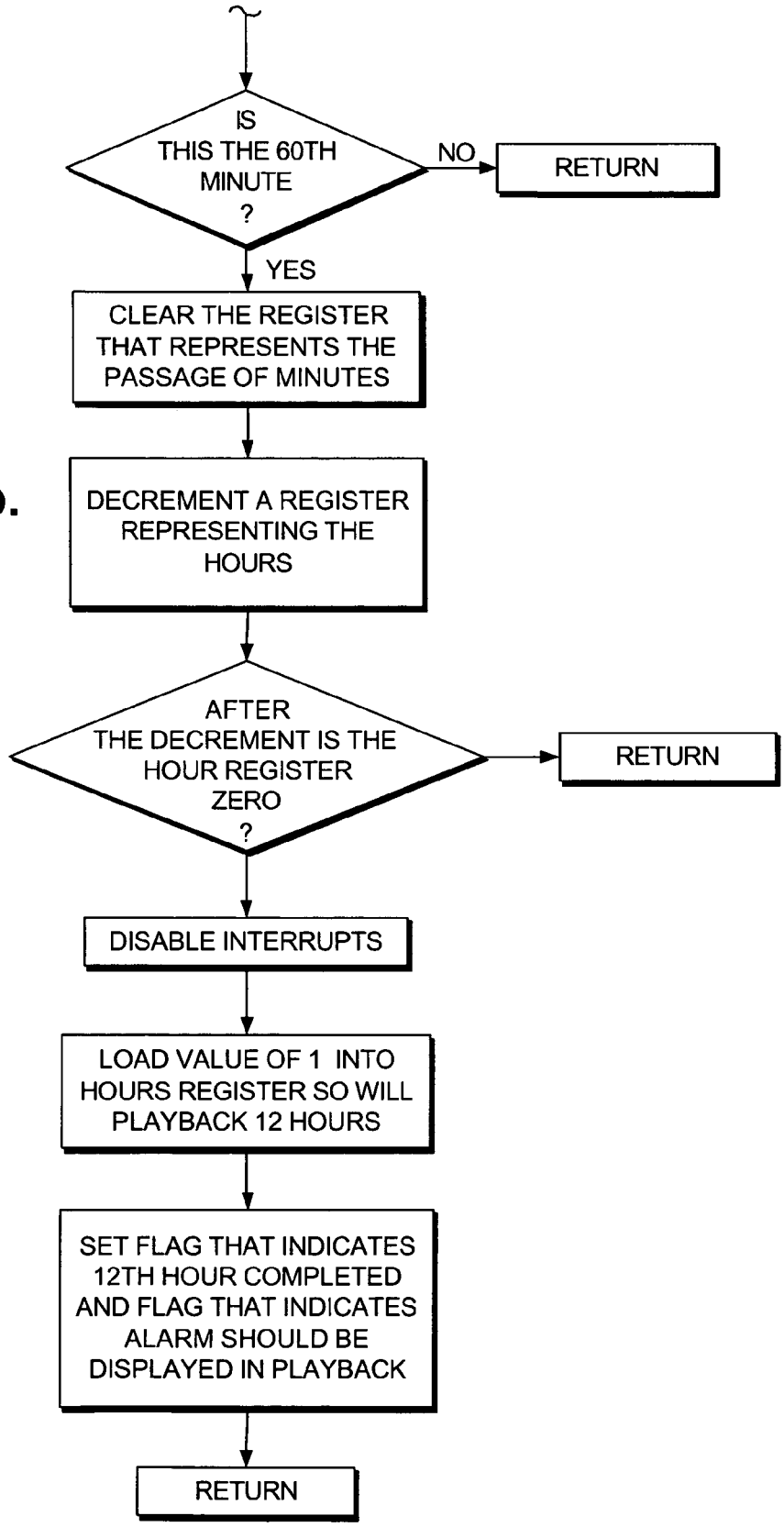
Figure 26:
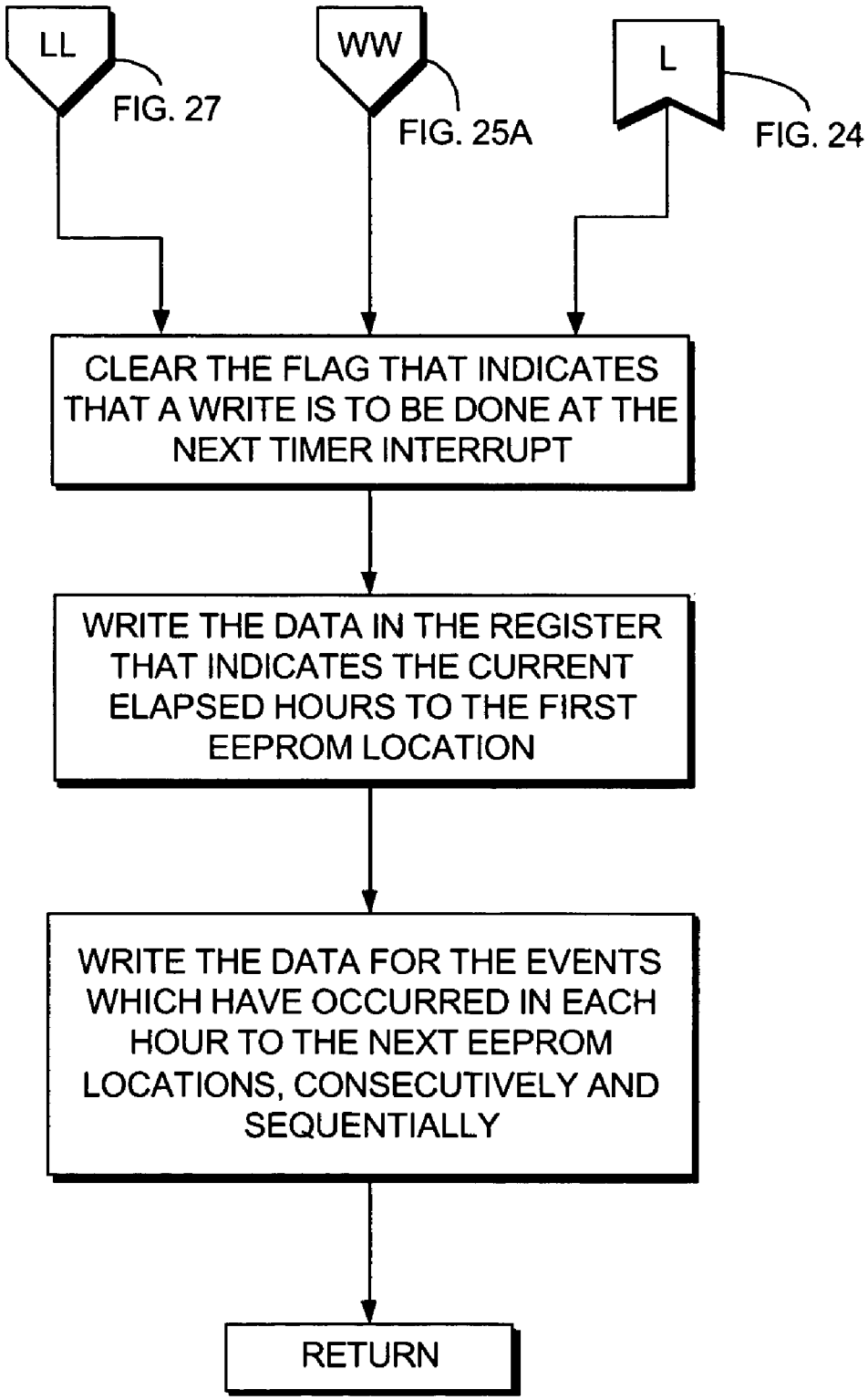
Figure 27:
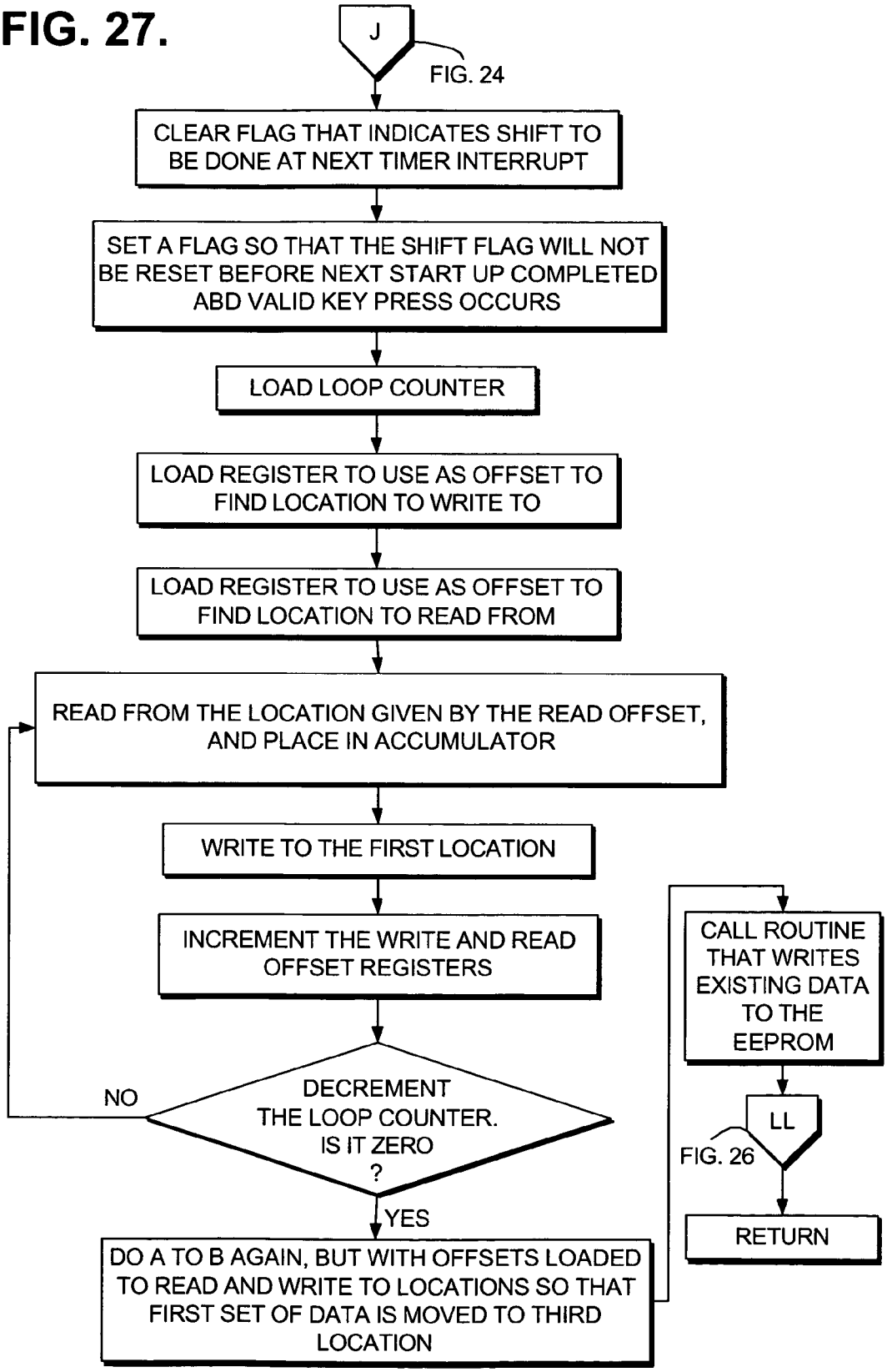

FIGS. 5A-27 are a very detailed flow diagrams for receiving and presenting mounting behavior in accordance with an embodiment of the present invention. The level of detail included in FIGS. 5A-27 should not be interpreted as limitations of the invention but rather a detailed illustration of a preferred embodiment of the present invention. FIGS. 5A-27 include several steps and adequately convey to one skilled in the art the functionality described without a need for a supplementary description here. To recite in words what the flow diagrams of FIGS. 5A-27 convey would unnecessarily lengthen the disclosure. It is to be well understood, however, that the level of detail provided in FIGS. 5A-27 is done so to illustrate merely one detailed embodiment of the present invention. For instance, FIG. 7 includes a decision step where a determination is made as to whether five presses of switch 126 have occurred (references to "key" are to switch 126, which may be the entire housing). Clearly "five" is merely one number selected. Checking for three, six, or some other number of switch presses is equally applicable. Similarly, FIG. 11 includes a step to load the register to test for sufficient brevity to qualify as a short key event to test for eight short key presses. Any number of key presses will work as well. "Eight" key presses is illustratively shown to reflect that such action would not likely be caused by breeding behavior.

Not all steps are necessary. The order of the steps is not mandatory. Those skilled in the art will appreciate alternative ways of providing the same functionality described in FIGS. 5A-27, which are contemplated within the scope of the present invention.

As can be seen, the present invention is well-adapted to provide a new and useful method for, among other things, determining an optimal time to artificially inseminate animals, such as cows. Many different arrangements of the various components depicted, as well as components not shown, are possible without departing from the spirit and scope of the present invention.

The present invention has been described in relation to particular embodiments, which are intended in all respects to be illustrative rather than restrictive. Alternative embodiments will become apparent to those skilled in the art that do not depart from its scope. For instance, additional LEDs may be employed to indicate that a cow permitted more behavior than merely a mount. Many alternative embodiments exist but are not included because of the nature of this invention. A skilled programmer may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need to be carried out in the specific order described.

The invention claimed is:

1. A method of using a monitoring device to present animal-mating behavior, the method comprising:

(a) receiving a first stimulus;

(b) validating that the first stimulus was received incident to a first mating-behavior event;

(c) receiving a second stimulus incident to a second mating-behavior event; and (d) storing the occurrence of the first stimulus along with a time indicator for future retrieval and display on a presentation interface, wherein the presentation interface includes an LED array.

2. The method of claim 1, wherein receiving the first stimulus includes receiving an indication of a status change from a first state to a second state.

3. The method of claim 2, wherein the first stimulus is received by a switch actuator.

4. The method of claim 2, wherein validating that the first stimulus was received incident to a first mating-behavior event includes observing a duration of the second state.

5. The method of claim 4, wherein receiving the second stimulus includes receiving an indication of a status change from the second state to a third state, wherein the third state includes the first state.

6. The method of claim 5, wherein the second stimulus is received from the switch actuator.

7. The method of claim 5, wherein validating that the second stimulus was received incident to a second mating-behavior event includes observing a duration of the third state.

8. The method of claim 7, wherein the first mating event includes a first animal attempting to mount a second animal.

9. The method of claim 1, further comprising displaying an indication of the first stimulus on the presentation interface.

10. The method of claim 9, further comprising successively repeating the steps (a), (b), (c), and (d) for a prescribed period of time.

11. The method of claim 10, further comprising iteratively displaying an indication of the stored first stimuli in connection with the respective corresponding time indicators on the LED array as mounting-behavior data is being gathered.

12. The method of claim 11, wherein the LED array includes twelve LEDs and each LED is to correspond to a predetermined duration of time.

13. The method of claim 12, wherein iteratively displaying includes causing each LED in the LED array to blink for a prescribed duration that corresponds to the respective time indicators and then to successively blink for a second duration, wherein the number of successive blinks corresponds to an accounting of recorded first stimuli.

14. A behavior-monitoring device comprising:

a switch;

a presentation component coupled to the switch; and one or more memory components coupled to the switch and to the presentation component and comprising one or more computer-readable media having computer-useable instructions embodied thereon for performing a method of monitoring animal-mating behavior, the method comprising:

(1) receiving an input from the switch corresponding to a first mating-behavior event;

(2) storing the input;

(3) storing a time indicator that can be used to denote a time marker associated with receiving the stored input;

(4) iteratively repeating steps (1)-(3) for a prescribed period of time to log mating-behavior events while displaying on the presentation component the stored input and the respective time indicator(s).

15. The behavior-monitoring device of claim 14, wherein the switch is adapted to respond to an external stimulus.

16. The behavior-monitoring device of claim 15, wherein the external stimulus corresponds to one or more behavior-monitoring events, which includes mounting behavior.

17. The behavior-monitoring device of claim 15, wherein the presentation component includes an information-rendering device that communicates to a rendering device the information of the data log.

18. The behavior-monitoring device of claim 17, wherein the rendering device includes one or more LEDs, wherein the one or more LEDs are arranged in physical configuration and blink according to a prescribed pattern to communicate the information of the data log in raw format to enable a reader to make a decision regarding insemination timing.

19. The behavior-monitoring device of claim 18, wherein storing the input includes validating the input.

20. A behavior-monitoring device comprising:

an actuator;

a presentation component coupled to the actuator, and one or more tangible computer-readable media having computer-useable instructions embodied thereon for performing a method of recording input that may correspond to mounting behavior, said method comprising:

(1) receiving a first stimulus that may correspond to a mating-behavior event;

(2) receiving a second stimulus that may correspond to a second mating-behavior event; and (3) if the second stimulus occurred after a defined time interval, then storing the occurrence of the first stimulus along with a time indicator for future retrieval and display on said presentation component.

21. The apparatus of claim 20, wherein said presentation component displays data that can be observed without removing said behavior-monitoring device from an animal.

22. The apparatus of claim 21, wherein said data is depicted by one or more flashing light objects.

23. The apparatus of claim 21, wherein said light objects include Light Emitting Diode(s)(LEDs).

24. The apparatus of claim 20, wherein actuator and presentation component are situated on a circuit board that is about 2 cm wide.

25. The apparatus of claim 20, wherein said mounting behavior indicates at least one of:

that said animal is in heat; and/or that said animal is ready for insemination.

* * * * *